US009343853B2

(12) United States Patent
Okada et al.

(10) Patent No.: US 9,343,853 B2
(45) Date of Patent: May 17, 2016

(54) SOLENOID

(71) Applicant: DENSO CORPORATION, Kariya, Aichi-pref. (JP)

(72) Inventors: Keita Okada, Chita-gun (JP); Masahiro Tomita, Obu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/626,039

(22) Filed: Feb. 19, 2015

(65) Prior Publication Data

US 2015/0244113 A1 Aug. 27, 2015

(30) Foreign Application Priority Data

Feb. 21, 2014 (JP) ..... 2014-31519

(51) Int. Cl.
*H01F 7/00* (2006.01)
*H01R 13/73* (2006.01)
*H01R 13/11* (2006.01)

(52) U.S. Cl.
CPC ..... *H01R 13/73* (2013.01); *H01R 13/112* (2013.01)

(58) Field of Classification Search
CPC ..... H01R 4/24; H01R 13/04; H01F 7/16; B60T 8/36
USPC ..... 335/278
See application file for complete search history.

(56) References Cited

U.S. PATENT DOCUMENTS 6,985,060 B2 * 1/2006 Parker ..... B60T 8/363 303/119.2
7,468,647 B2 * 12/2008 Ishibashi ..... F16K 31/0613 251/129.15
8,534,641 B2 * 9/2013 Schalowski ..... B60T 8/3675 251/129.15
2004/0089832 A1 * 5/2004 Wilde ..... B60T 8/3675 251/129.15
2005/0062005 A1 * 3/2005 Shimura ..... F16K 31/0613 251/129.15
2005/0201867 A1 * 9/2005 Hirota ..... F04B 27/1804 417/222.2
2006/0243938 A1 * 11/2006 Ishibashi ..... F16K 31/0613 251/129.15
2014/0065895 A1 3/2014 Tomita et al.

FOREIGN PATENT DOCUMENTS

KR 10-2009-0084753 8/2009

* cited by examiner

*Primary Examiner* — Shawki S Ismail
*Assistant Examiner* — Lisa Homza
(74) *Attorney, Agent, or Firm* — Nixon & Vanderhye PC

(57) ABSTRACT

A clip installation seat of a holder, which is installed to an outer surface of a yoke, includes a recessed slope surface that is sloped in such a manner that an amount of recess of a radially-inner-side section of the recessed slope surface is larger than an amount of recess of a radially-outer-side section of the recessed slope surface. A clip includes an engaging hole, which is press fitted to an outer peripheral surface of a positioning projection projected from the outer surface of the yoke, and a radially-inner-side engaging portion, which resiliently contacts the outer peripheral surface of the positioning projection. The clip includes a radially-outer-side engaging portion that is configured into a form of a loop and is placed at a radially-outer-side area of the clip. The radially-outer-side engaging portion resiliently contacts the recessed slope surface.

15 Claims, 12 Drawing Sheets

SOLENOID

CROSS REFERENCE TO RELATED APPLICATION

This application is based on and incorporates herein by reference Japanese Patent Application No. 2014-31519 filed on Feb. 21, 2014.

TECHNICAL FIELD

The present disclosure relates to a solenoid that includes terminals to be connected with external mating terminals.

BACKGROUND

For example, KR20090084753A discloses a spool control valve that has a solenoid actuator (hereinafter referred to as a solenoid) 200, as shown in FIG. 13. The solenoid 200 drives a spool valve 101, which is a valve element of the spool control valve, toward an adjust screw 104 in a spool hole 103 of a sleeve 102 (i.e., toward an opening of the spool hole 103) against an urging force of a return spring 120.

The solenoid 200 includes a coil 106, a stator core (a radially-inner-side stationary core) 107, a yoke (a radially-outer-side stationary core) 108 and a plunger 109. The coil 106 is wound around a bobbin 105 that is made of a synthetic resin material. The stator core 107 is configured into a cylindrical tubular form and is placed on a radially inner side of the coil 106. The yoke 108 is configured into a cylindrical tubular cup form and is placed on a radially outer side of the coil 106. The plunger 109 is movable in an inside of the stator core 107.

Furthermore, the solenoid 200 includes two primary terminals 111, two secondary terminals 112 and a holder 113. The primary terminals 111 and the secondary terminals 112 are used to supply an electric power to the coil 106. The holder 113 has a function of a connector case, to which an external mating connector is fitted.

Each of the primary terminals 111 is used as a coil terminal (a terminal at the coil side) and includes an inner connection and a primary intermediate connection. The inner connection of each primary terminal 111 is joined to a corresponding conductor body (a conductor line), which forms the coil 106. The primary intermediate connection of each primary terminal 111 is joined to and is electrically connected to a corresponding one of the secondary terminals 112.

Each of the secondary terminals 112 is used as an external side coil terminal and includes an outer connection (a tuning fork terminal portion) and a secondary intermediate connection. The outer connection of each secondary terminal 112 is fitted to an outer connection (a tab terminal portion) of a corresponding one of two external mating terminals of the external mating connector. The secondary intermediate connection of each secondary terminal 112 is joined to and is electrically connected to the primary intermediate connection of the corresponding primary terminal 111 by, for example, welding or crimping.

In the solenoid 200, a distal end portion (a snap fit claw 117) of a resilient engaging piece 116, which projects from the holder 113 through a through-hole 115 formed in a bottom portion 114 of the yoke 108, is snap fitted to an engaging part 118, which is formed in an inner surface of the bottom portion 114 of the yoke 108, so that the holder 113 is snap fitted to an outer surface of the bottom portion 114 of the yoke 108. Since the fixing method of the holder 113 relative to the outer surface of the bottom portion 114 of the yoke 108 is the snap fitting, rattling will occur at the snap fit connection between the snap fit claw 117 of the resilient engaging piece 116 and the engaging part 118 of the bottom portion 114. At the time of occurrence of the rattling at the snap fit connection, a positional deviation may occur between the primary intermediate connection of each primary terminal 111 and the secondary intermediate connection of the corresponding secondary terminal 112, and a positional deviation may also occur between the outer connection of each secondary terminal 112 and the outer connection of the corresponding external mating terminal. Therefore, there is a difficulty with respect to achievement of a required reliability of the electrical connection at the primary and secondary intermediate connections and a required reliability of the electrical connection at the outer connections.

In view of the above disadvantage, in order to achieve the required reliability of the electrical connection at the primary and secondary intermediate connections of the primary and secondary terminals and a required reliability of the electrical connection at the outer connections of the secondary terminal and the external mating terminal, the inventors of the present application have previously proposed and tested a linear solenoid (comparative example) shown in FIGS. 14 to 15B.

In the linear solenoid of the comparative example shown in FIGS. 14 to 15B, two of terminals, each of which includes the inner connection and the outer connection formed integrally together in the terminal, are used in place of the primary and secondary terminals of the prior art solenoid. Therefore, it is possible to eliminate the connecting structure between each primary terminal and the corresponding secondary terminal and the connecting operation for connecting between each primary terminal and the corresponding secondary terminal.

In the linear solenoid of the comparative example, with reference to FIG. 14, the following method is used as a fixing method for fixing a terminal holder (hereinafter referred to as a holder) 121, which receives and holds the terminals discussed above, to an outer surface (a holder installation seat surface 119) of the bottom portion 114 of the yoke 108.

Specifically, in the linear solenoid of the comparative example, an inside-to-outside communication hole is formed in the bottom portion 114 of the yoke 108, which is configured into the cylindrical tubular cup form. Furthermore, the terminals are projected from an inside to an outside of the yoke 108 through the inside-to-outside communication hole of the bottom portion 114, and two positioning projections 122 project from the holder installation seat surface 119 of the bottom portion 114 of the yoke 108 to the outside of the yoke 108.

A fitting hole 124 is formed at a center portion of each of two flanges 123 of the holder 121. The positioning projections 122 are fitted into the fitting holes 124, respectively, to position the holder 121 in a predetermined position in the holder installation seat surface 119. Thereafter, an engaging hole 126 of a clip 125, which is made of a resiliently deformable thin metal plate, is press fitted to each of the positioning projections 122.

Specifically, as shown in FIG. 15A, at the time of press fitting the clip 125 to the corresponding positioning projection 122, a press fitting load is applied to the clip 125 to resiliently contact the clip 125 to both of the flange 123 and the positioning projection 122. Then, after the press fitting of the clip 125 to the corresponding positioning projection 122, a yoke contact surface 127 of the holder 121 is urged toward the bottom portion 114 of the yoke 108 through use of a resilient restoring force of the clip 125, so that the yoke contact surface 127 of the holder 121 fluid-tightly contacts the holder installation seat surface 119 of the bottom portion 114 of the yoke 108.

The linear solenoid of the comparative example has a foreign object intrusion limiting function. Specifically, since the yoke contact surface 127 of the holder 121 fluid-tightly contacts the outer surface of the bottom portion 114 of the yoke 108, it is possible to limit intrusion of the foreign objects, such as conductive foreign particles (particulate contaminants), into the inside of the yoke 108 through the inside-to-outside communication hole of the bottom portion 114.

Furthermore, two tapered guide surfaces 132 are formed in each of two terminal insertion holes 131, through which the tab terminal portions of the external mating terminals are inserted into terminal receiving chambers of the holder 121. Therefore, at the time of fitting the external mating connector to the holder 121, the tab terminal portions of the external mating terminals can be easily inserted into the terminal receiving chambers, respectively.

However, in the case of the linear solenoid of the comparative example, the clip 125 may possibly be sprung back after the press fitting of the clip 125 to the corresponding positioning projection 122, so that the clip 125 may possibly be lifted away from an installation seat surface of the corresponding flange 123 of the holder 121, as indicated in FIG. 15B.

When this phenomenon occurs, a clearance is formed between the flange 123 and the clip 125 to cause formation of a gap between the yoke contact surface 127 of the holder 121 and the outer surface of the bottom portion 114 of the yoke 108. Thereby, the foreign object intrusion limiting function discussed above may possibly be lost.

SUMMARY

The present disclosure addresses the above disadvantages.

According to the present disclosure, there is provided a solenoid that includes a yoke, an inside-to-outside communication hole, a positioning projection, a plurality of terminals, a holder, and a clip. The yoke is configured into a cup form and forms a magnetic circuit in cooperation with a coil. The inside-to-outside communication hole extends through a bottom portion of the yoke to communicate between an inside and an outside of the yoke. The positioning projection projects outward from a corresponding part of an outer surface of the bottom portion, which is different from the inside-to-outside communication hole. The terminals project from the inside of the yoke to the outside of the yoke through the inside-to-outside communication hole to connect with a plurality of external mating terminals of an external mating connector, which conduct an electric current to energize the coil. The holder is installed to the outer surface of the bottom portion and closes the inside-to-outside communication hole. The holder includes a terminal receiving space and a fitting hole. The terminal receiving space is formed in an inside of the holder to receive and hold the plurality of terminals. The positioning projection is fitted into the fitting hole. The fitting hole is placed on an outer side of the terminal receiving space. The clip is made of a resilient material and fixes the holder to the outer surface of the bottom portion. The clip includes an engaging hole and a radially-inner-side engaging portion. The engaging hole is press fitted to an outer peripheral surface of the positioning projection. The radially-inner-side engaging portion is configured into a form of a loop and resiliently contacts the outer peripheral surface of the positioning projection. The holder includes a yoke contact surface and a clip installation seat. The yoke contact surface is configured into a form of a loop and surrounds the plurality of terminals. The yoke contact surface contacts the outer surface of the bottom portion. The clip installation seat is configured into a form of a loop and extends radially outward from a peripheral edge part of the fitting hole. The clip installation seat includes a recessed slope surface that is configured into a form of a loop and is sloped in such a manner that an amount of recess of a radially-inner-side section of the recessed slope surface is larger than an amount of recess of a radially-outer-side section of the recessed slope surface, which is located on a radially outer side of the radially-inner-side section of the recessed slope surface. The clip includes a radially-outer-side engaging portion that is configured into a form of a loop and is placed at a radially-outer-side area of the clip. The radially-outer-side engaging portion resiliently contacts the recessed slope surface.

BRIEF DESCRIPTION OF THE DRAWINGS

The drawings described herein are for illustration purposes only and are not intended to limit the scope of the present disclosure in any way.

DETAILED DESCRIPTION

Figure 1A:
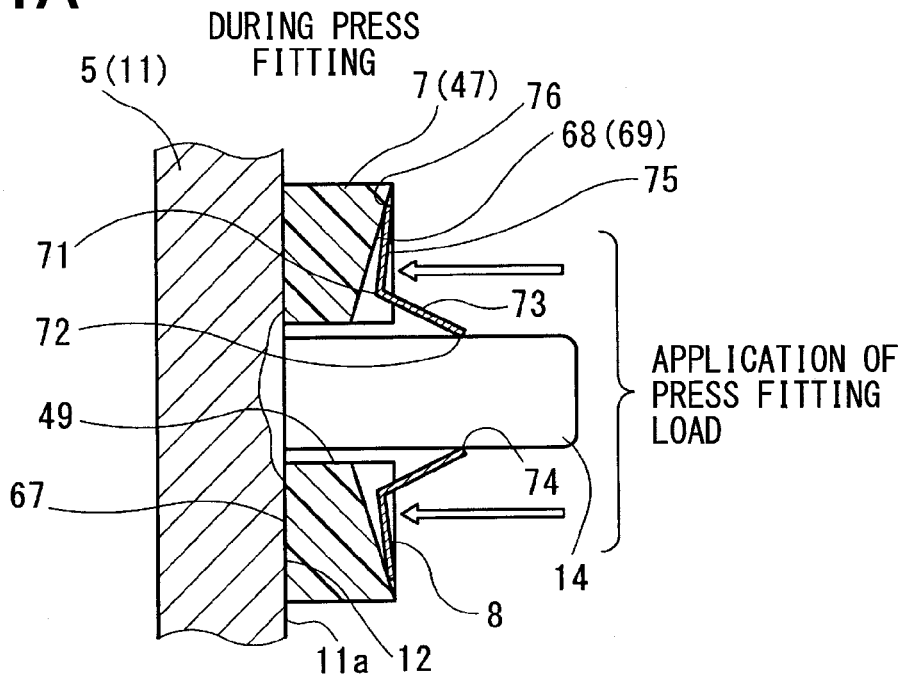
FIG. 1A is a descriptive diagram showing a state of a clip at a time of press fitting the clip according to a first embodiment of the present disclosure.

Various embodiments of the present disclosure will be described with reference to the accompanying drawings.

First Embodiment

FIGS. 1A to 11 show a linear solenoid valve, which includes a linear solenoid 100 according to a first embodiment of the present disclosure.

The linear solenoid valve (also referred to as a solenoid spool control valve, or a solenoid valve) of the present disclosure is installed in an oil pressure control apparatus of an automatic transmission.

The oil pressure control apparatus is used, for example, in a speed change control operation of the automatic transmission installed in a vehicle (e.g., an automobile). The oil pressure control apparatus includes an oil pump (not shown), a valve body (not shown), a plurality of linear solenoid valves, and a control unit (e.g., a transmission control unit abbreviated as "TCU" not shown). The oil pump draws oil from an oil pan and pumps the drawn oil. The valve body includes a plurality of oil passages. The linear solenoid valves are installed to the valve body and form an oil pressure circuit in cooperation with the oil passages of the valve body. The control unit controls energization of the linear solenoid valves to implement a demanded speed change state, which is demanded by a driver of the vehicle.

A housing of the automatic transmission is formed by an automatic transmission case (a transmission case) and the oil pan.

A torque converter and a speed change mechanism are received in the automatic transmission case. The torque converter includes a pump, a turbine and a stator. The speed change mechanism is of a multi-stage gear type and is connected to the turbine of the torque converter. The speed change mechanism includes a plurality of friction engaging elements (clutches and/or brakes), which are coupled or decoupled with each other in response to the oil pressure supplied from the oil pressure control apparatus.

A shift range is changed in the automatic transmission according to a combination of the coupling or decoupling of corresponding ones of the friction engaging elements. In this way, the speed change control operation of the automatic transmission is performed.

The oil pump serves as an oil pressure generating means and is rotated by a crankshaft of the engine (or an electric motor) to draw the oil from the oil pan (or an oil tank), which is a storage container that stores the oil used in the automatic transmission. An oil supply flow passage (an oil passage) is connected to an outlet of the oil pump, and the linear solenoid valves are placed at a downstream end of the oil supply flow passage.

At least one of the linear solenoid valves includes a spool valve (hereinafter referred to as a spool control valve) and the linear solenoid 100. The spool control valve adjusts an oil pressure of the oil, which is a pressure fluid. The linear solenoid 100 is a solenoid actuator that drives a valve element (a valve spool that will be hereinafter referred to as a spool) of the spool control valve.

The spool control valve includes a valve sleeve (hereinafter referred to as a sleeve), the spool, a return spring and an adjust screw. The sleeve is configured into a cylindrical tubular form and is fitted into a valve insertion groove (recess) of the valve body. The spool is received in a spool hole (hereinafter referred to as a guide hole) of the sleeve in a manner that enables reciprocation (slide movement) of the spool. The return spring urges the spool toward the solenoid side (a base end side, a default position side). The adjust screw adjusts a spring load of the return spring.

The spool contacts one end surface of a shaft 2, which extends from an inside of the guide hole to an inside of the linear solenoid 100. The other end surface of the shaft 2 contacts a contact portion of a plunger (described later) 29. In this way, the spool control valve drives the spool through the shaft 2 by moving the plunger 29 in an axial direction of the plunger 29.

The guide hole is formed in an inside of the sleeve and linearly extends in the axial direction. The guide hole is a slide hole (an inside hole), in which the spool slides.

A plurality of oil supply and discharge ports, through which the oil is inputted or outputted, is formed in the sleeve to communicate between the inside and an outside of the sleeve. These oil supply and discharge ports communicate between an outer peripheral surface (the outside) of the sleeve and an inside of the guide hole in a radial direction that is perpendicular to an axial direction of the guide hole.

The oil supply and discharge ports include an input port, an output port and a drain port (discharge port).

The input port is a port (an oil supply port), through which an input pressure of the oil is inputted to the inside of the guide hole from the oil pump through a first oil passage.

The output port is a port, through which a predetermined output pressure of the oil is outputted from the inside of the guide hole to an oil pressure servomechanism of the clutch (or the brake) through a second oil passage after adjustment of the input pressure of the oil to the predetermined output pressure.

The drain port is a port, through which the oil supplied into the inside of the guide hole from the input port or the output port is outputted from the inside of the guide hole to the oil pan through a third oil passage.

Besides the above-described ports, the oil supply and discharge ports further include a feedback (F/B) port for limiting a change in the output pressure of the oil, which is outputted from the output port. The feedback port is connected to a fourth oil passage (a feedback oil passage), which is communicated with the output port.

The linear solenoid valve of the present embodiment is a solenoid spool valve (a solenoid valve) of a normally open type. Specifically, in a state where supply of an electric power to the solenoid coil (hereinafter referred to as a coil) 1 of the linear solenoid 100 is stopped, the input port and the output port are communicated with each other, and the output port and the drain port are discommunicated from each other. Furthermore, in a state where the supply of the electric power to the coil 1 is increased, a cross-sectional area of a connection between the input port and the output port is reduced in a stepwise manner or a linear manner, and a cross-sectional area of a connection between the output port and the drain port is increased in a stepwise manner or a linear manner.

The linear solenoid 100 is the solenoid actuator, which drives the spool toward one side (a left side in FIG. 2) in the axial direction of the spool through the shaft 2 made of a non-magnetic material. Besides the coil 1, the linear solenoid 100 includes a coil bobbin (hereinafter referred to as a bobbin) 3, two coil lead lines 4, a plunger (a movable core) 29, a stator core (a radially-inner-side stationary core) 130, a yoke (a radially-outer-side stationary core) 5, and a connector 40 (including two terminals 6, a holder 7 and two clips 8, which will be described later). The connector 40 is for making an external electrical connection.

The coil 1 includes a coil portion 1*a* and the two coil lead lines 4. The coil portion 1*a* is wound around an outer peripheral surface of the bobbin 3 and is configured into a cylindrical tubular form. The coil lead lines 4, which serve as two internal conductor portions, respectively, of the present disclosure, extend from two coil ends of the coil portion 1*a* and are pulled out from the yoke 5 through an inside-to-outside communication hole 13, which is described later. The coil lead lines 4 are electrically connected to the terminals 6, respectively. The terminals 6 are configured to be fitted to and electrically connected to two external mating terminals 9, respectively, which are held by an external mating connector 90.

The yoke 5 is configured into a cylindrical tubular cup form and forms a magnetic circuit in cooperation with the coil 1. The yoke 5 forms the radially-outer-side stationary core. The yoke 5 includes a bottom portion 11, which has a predetermined plate thickness (wall thickness) measured in a direction of a central axis of the linear solenoid 100 that coincides with a central axis of the shaft 2 (hereinafter referred to as a solenoid axial direction).

An outer surface 11*a* of the bottom portion 11 of the yoke 5 includes a holder installation seat surface 12, to which the holder (terminal holder) 7 is installed in a state where a resilient force (a resilient restoring force) of the clips (fixing clips) 8 is exerted against the holder 7, so that a yoke contact surface 67 of the holder 7, which will be described later, tightly contacts the holder installation seat surface 12 along an entire perimeter of the yoke contact surface 67. Furthermore, the inside-to-outside communication hole 13 is formed in the bottom portion 11 of the yoke 5 such that the inside-to-outside communication hole 13 extends through the bottom portion 11 in a thickness direction (plate thickness direction) of the bottom portion 11, which is parallel to the direction of the central axis of the linear solenoid 100, to communicate between an inside and an outside of the yoke 5. A plurality (two in this embodiment) of positioning projections 14 projects outward from the outer surface 11*a* (more specifically, the holder installation seat surface 12) of the bottom portion 11.

Each terminal 6 includes a base end portion 21, an inner connection (an inner conducting portion) 22, a tuning fork terminal portion (a primary outer terminal portion or an outer connection) 23, and an intermediate connection 24. The base end portion 21 is located at a base end side of the terminal 6 and is securely embedded in a molded resin portion (serving as a molded member) 15, more specifically a corresponding one of two terminal projecting portions 16*a* of a bobbin projection (or simply referred to as a projection) 16 of the molded resin portion 15, which will be described later and is molded integrally with the bobbin 3. A corresponding one of the coil lead lines 4 is connected to the inner connection 22 to form an electrical connection between the coil lead line 4 and the inner connection 22. The tuning fork terminal portion (also referred to as a U-shaped terminal portion) 23, which will be hereinafter referred to as a fork terminal portion, is provided at an opposite side (a distal end side) of the terminal 6, which is opposite from the base end portion 21. The intermediate connection 24 connects between the inner connection 22 and the fork terminal portion 23.

The fork terminal portion 23 is fitted to a tab terminal portion (a secondary terminal portion) 25 of the corresponding one of the external mating terminals 9.

The intermediate connection 24 of each terminal 6 includes a planar portion 26. Two external test contacts 30 (see FIG. 7) of a conductivity check device (a tester), which is used to test a state of electrical conductivity of the coil 1 and the terminals 6 at a time of factory shipment of the linear solenoid valve, are contactable with the planar portions 26, respectively, of the terminals 6. The planar portions 26 serve as electrode portions of the terminals 6 of the present disclosure. Each planar portion 26 is placed in an inside of a corresponding one of two primary terminal receiving chambers 51 and a corresponding one of two secondary terminal receiving chambers 52, which will be described later.

The coil 1 generates a magnetic force to drive the spool, the shaft 2 and the plunger (movable core) 29 toward the one side (the left side in FIG. 2) in the axial direction of the sleeve (the solenoid axial direction) upon energization of the coil 1.

The coil 1 is a solenoid coil, which is formed by winding a conductive wire, which is coated with a dielectric film, multiple times around the bobbin 3 made of synthetic resin (a molding resin material) that is dielectric. The coil 1 includes the coil portion 1*a*, which is wound around the outer peripheral surface of the bobbin 3 and is configured into the cylindrical tubular form, and the coil lead lines 4, which extend from the coil ends (a winding start end and a winding terminal end) of the coil portion 1*a* and are pulled out from the yoke 5 through the inside-to-outside communication hole 13.

In the linear solenoid 100 of the present embodiment, when the coil 1 is energized (turning on of the energization), the spool, the shaft 2 and the plunger 29 are moved from an initial position (a default position) toward the one side (a distal end side) in the solenoid axial direction. When the coil 1 is deenergized (turning off of the energization), the spool, the shaft 2 and the plunger 29 are returned to the default position by the urging force of the return spring.

The shaft 2 is placed along the central axis of the sleeve of the linear solenoid valve. The shaft 2 conducts the drive force of the plunger 29, which is exerted toward the one side in the axial direction (the solenoid axial direction), to the spool. Also, the shaft 2 conducts the urging force of the return spring, which is exerted to the spool, to the plunger 29.

The bobbin 3 includes the molded resin portion 15. The molded resin portion 15 serves as a lead line holder, which guides an intermediate portion of each of the coil lead lines 4. The molded resin portion 15 also serves as a terminal holder, in which the base end portions 21 of the terminals 6 are securely embedded. The bobbin projection (a terminal support portion) 16, which is configured into an arcuate form, is formed integrally at a distal-end-side section of the molded resin portion 15 such that the bobbin projection 16 projects outward from the outer surface 11*a* of the bottom portion 11 through the inside-to-outside communication hole 13.

The conductive wire, which is coated with the dielectric film, is wound multiple times around an outer peripheral surface of a cylindrical tubular portion 17 of the bobbin 3, which is located between two flanges 18. A coil receiving space, which is configured into a cylindrical tubular form, is defined along the outer peripheral surface of the cylindrical tubular portion 17 between the flanges 18 to receive the coil portion 1*a* of the coil 1. The molded resin portion 15 is formed integrally with one of the flanges 18 (more specifically, the flange 18 shown in FIG. 2). A slit is formed in the molded resin portion 15 and the one of the flanges 18 to receive the intermediate portions of the coil lead lines 4.

The coil lead lines 4 are conductor bodies (electrical conductor bodies), which form the coil 1 that is wound around the bobbin 3, i.e., is wound around the outer peripheral surface of the cylindrical tubular portion 17 between the flanges 18. Each of the coil lead lines 4 is connected to an external circuit(s), such as the external electric power source and the external control circuit (e.g., the TCU), through the fork terminal portion 23 of the corresponding one of the terminals 6.

The intermediate portion of each of the coil lead lines 4 is pulled to the outside of the molded resin portion 15 (the outside of the yoke 5) through the slit of the bobbin 3.

Each of the coil lead lines 4 includes a primary projection, which projects from the one of the flanges 18 of the bobbin 3 and extends through the slit of the molded resin portion 15. The primary projections of the coil lead lines 4 are pulled to the outside of the yoke 5 through the inside-to-outside communication hole 13, which is formed in the bottom portion 11 of the yoke 5 and is configured into the arcuate form. Each of the primary projections of the coil lead lines 4, which project from the bottom portion 11 of the yoke 5 and an outer surface of the molded resin portion 15 of the bobbin 3, includes a binding portion and a lead line terminal end portion. The binding portion of the primary projection is spirally wound around the inner connection 22 of the corresponding terminal 6, and the lead line terminal end portion of the primary projection is joined to the inner connection 22 by fusing in a fusing process.

The plunger (the movable core) 29 is made of magnetic metal (e.g., a ferromagnetic material, such as iron) that is magnetized upon energization of the coil 1. The plunger 29 is placed on a radially inner side of the stator core 130 (including a stator core portion 31, a stator core portion 32, and a magnetic resistance portion 33, which will be described later) in such a manner that the plunger 29 is slidable and reciprocatable in the solenoid axial direction.

The plunger 29 is the movable core (a moving core), which is magnetically attracted toward the one side in the solenoid axial direction by the magnetic force of the coil 1 upon energization of the coil 1. The plunger 29 is urged together with the spool and the shaft 2 toward the bottom portion 11 of the yoke 5, which is configured into the cylindrical tubular cup form, by the urging force of the return spring that is conducted to the spool.

Furthermore, a slide surface is formed in an outer peripheral surface of the plunger 29 to directly and slidably contact an inner peripheral surface of the stator core 130.

The plunger 29 is received in an inside (a plunger chamber) of the stator core 130 in such a manner that the plunger 29 is slidable and reciprocatable in the solenoid axial direction. The plunger chamber includes a plunger front space 34 and a plunger rear space 35, which are placed on a front side and a rear side, respectively, of the plunger 29 in the solenoid axial direction.

The plunger front space 34 and the plunger rear space 35 serve as a first volume variable portion and a second volume variable portion, respectively. A volume of the first volume variable portion (i.e., the plunger front space 34) and a volume of the second volume variable portion (i.e., the plunger rear space 35) change during an operation of the linear solenoid 100. The plunger front space 34 and the plunger rear space 35 are communicated with each other through a plunger breathing hole 36, which extends through the plunger 29 in the axial direction.

The plunger breathing hole 36, which communicates between a front end surface and a rear end surface of the plunger 29, linearly extends through the plunger 29 to ensure flow of the oil in the plunger front space 34 and the plunger rear space 35 upon displacement of the plunger 29 in the plunger chamber.

The stator core 130 includes the stator core portion (front side stator core portion) 31, the stator core portion (rear side stator core portion) 32 and the magnetic resistance portion 33. The stator core portion 31 magnetically attracts the plunger 29 toward the front end side (the one side) in the solenoid axial direction. The stator core portion 32 receives and gives a magnetic flux relative to an outer peripheral surface of the plunger 29. The magnetic resistance portion 33 reduces a flow of the magnetic flux between the stator core portion 31 and the stator core portion 32. The stator core portion 31, the stator core portion 32 and the magnetic resistance portion 33 are formed integrally as a one-piece component. Alternatively, the stator core portion 31, the stator core portion 32 and the magnetic resistance portion 33 may be formed separately and connected together.

The stator core portion 31, the stator core portion 32 and the magnetic resistance portion 33 are made of magnetic metal (a ferromagnetic material, such as iron), which is magnetized upon energization of the coil 1. The stator core portion 31 and the stator core portion 32 form the magnetic circuit in corporation with the coil 1, the yoke 5, the plunger 29 and the ring core 37.

An annular flange (not shown), which is located at the front end side of the stator core portion 31, serves as a stationary core that covers one end side of the coil 1.

Furthermore, the linear solenoid 100 includes the ring core (a portion of the stationary core that covers the other end side of the coil 1, which is opposite from the one end side in the axial direction of the coil 1) 37, and a wave washer 38. The ring core 37 is made of a magnetic material and is placed between the coil 1 and the bottom portion 11 of the yoke 5. The wave washer 38 exerts a resilient force that urges the ring core 37 toward the bottom portion 11. These constituent components (i.e., the plunger 29, the stator core portion 31, the stator core portion 32, the magnetic resistance portion 33, the ring core 37, and the wave washer 38) of the linear solenoid 100 are received in the inside of the yoke 5, which forms an outer shell of the linear solenoid 100.

The radially-outer-side stationary core is formed by the yoke 5 that is made of the magnetic metal (e.g., the ferromagnetic material, such as iron), which is magnetized upon the energization of the coil 1. The yoke 5 is formed into the cylindrical tubular cup form through a drawing process of a magnetic steel plate through use of, for example, a press machine. Specifically, one end side (the spool control valve side) of a cylindrical tubular portion of the yoke 5 is opened, and the other end side (the holder side) of the cylindrical tubular portion of the yoke 5 is closed with the bottom portion 11, which is configured into a circular disk plate form.

The yoke 5 forms the magnetic circuit in cooperation with the coil 1, the plunger 29, the stator core portion 31, the stator core portion 32, and the ring core 37.

The yoke 5 includes a cylindrical peripheral wall plate, which is configured into a cylindrical tubular form and covers an outer peripheral surface of the coil 1. In the yoke 5, the one end side (the spool control valve side) of the cylindrical peripheral wall plate is opened, and the other end side of the cylindrical peripheral wall plate, which is opposite from the one end side in the axial direction, is closed with the bottom portion (the bottom plate) 11, which is configured into the circular disk plate form. Furthermore, the holder installation seat surface 12 is formed in a predetermined location of the outer surface 11*a* of the bottom portion 11 of the yoke 5. The holder 7 is installed to the holder installation seat surface 12 in the state where the yoke contact surface (described later) 67 of the holder 7 tightly contacts the holder installation seat surface 12 without forming a clearance between the holder installation seat surface 12 and the yoke contact surface 67. The holder installation seat surface 12 is formed to surround the inside-to-outside communication hole 13 on the outer surface 11*a* of the bottom portion 11 of the yoke 5.

The yoke 5 is placed such that the yoke 5 surrounds the coil 1 in a circumferential direction. A solenoid receiving space is formed in the inside of the yoke 5 to receive the constituent components (e.g., the coil 1, the bobbin 3, the plunger 29, the stator core portion 31, the stator core portion 32, the magnetic resistance portion 33 and the ring core 37) of the linear solenoid 100.

A cylindrical tubular opening part of the cylindrical tubular portion of the yoke 5 is securely crimped against an annular flange (not shown) of the sleeve.

The bottom portion 11 of the yoke 5, which is located at the other end side of the cylindrical tubular portion of the yoke 5, includes the inside-to-outside communication hole 13 that is configured into the arcuate form and serves as a terminal receiving hole, through which the primary projections of the coil lead lines 4 and the base end portions 21 of the terminals 6 are received.

The inside-to-outside communication hole 13 is a through-hole that extends through the bottom portion 11 of the yoke 5 in the direction (the plate thickness direction of the bottom portion 11), which is parallel to the solenoid axial direction, to communicate between the inside and the outside of the yoke 5. The inside-to-outside communication hole 13 communicates between the inner surface 11*b* and the outer surface 11*a* of the bottom portion 11 of the yoke 5.

The positioning projections 14 are formed integrally with the bottom portion 11 of the yoke 5 and project from the outer surface 11*a* of the bottom portion 11 of the yoke 5 such that each positioning projection 14 projects outward from a corresponding part of the outer surface 11*a* of the bottom portion 11, which is different from the inside-to-outside communication hole 13.

The positioning projections 14 are parallel to each other and are located on one side and the other side, respectively, of the primary terminal receiving chambers (serving as primary receiving recesses of the present disclosure) 51 and the secondary terminal receiving chambers (serving as secondary receiving recesses of the present disclosure) 52. Furthermore, the positioning projections 14 linearly outwardly extend in the solenoid axial direction from the outer surface 11*a* (the holder installation seat surface 12) of the bottom portion 11. The positioning projections 14 are formed integrally with the bottom portion 11 of the yoke 5. Alternatively, the positioning projections 14 may be formed separately from the bottom portion 11 of the yoke 5 and may be securely installed to the bottom portion 11 of the yoke 5.

Figure 4A:
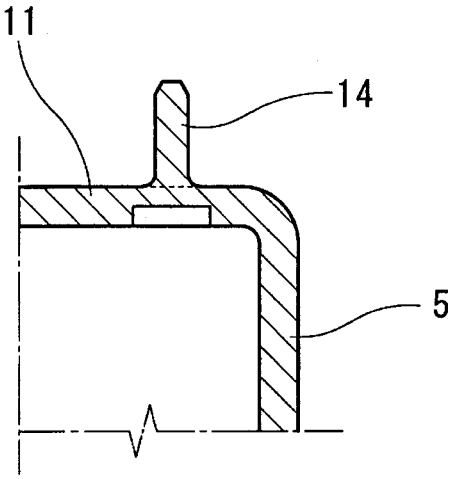
FIG. 4A is a partial cross sectional view showing a specific example of a positioning projection integrated to a bottom portion of the yoke according to the first embodiment.

As shown in FIG. 4A, the positioning projections 14 are formed integrally and seamlessly with the bottom portion 11 of the yoke 5 by, for example, an extrusion process in such a manner that the positioning projections 14 are projected from the outer surface 11*a* of the bottom portion 11 of the yoke 5 in the installation direction of the holder 7 to the outer surface 11*a* of the bottom portion 11 (the solenoid axial direction).

Figure 4B:
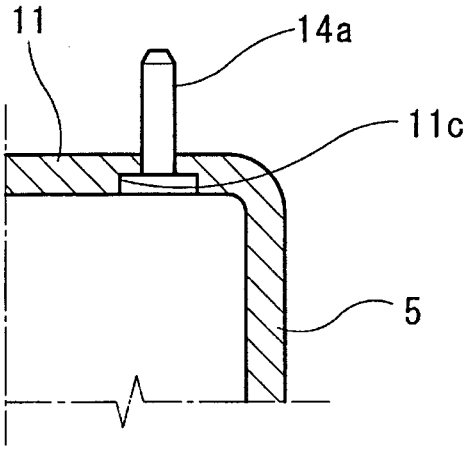
FIG. 4B is a partial cross sectional view showing another specific example of the positioning projection integrated to the bottom portion of the yoke according to the first embodiment.
Figure 5:
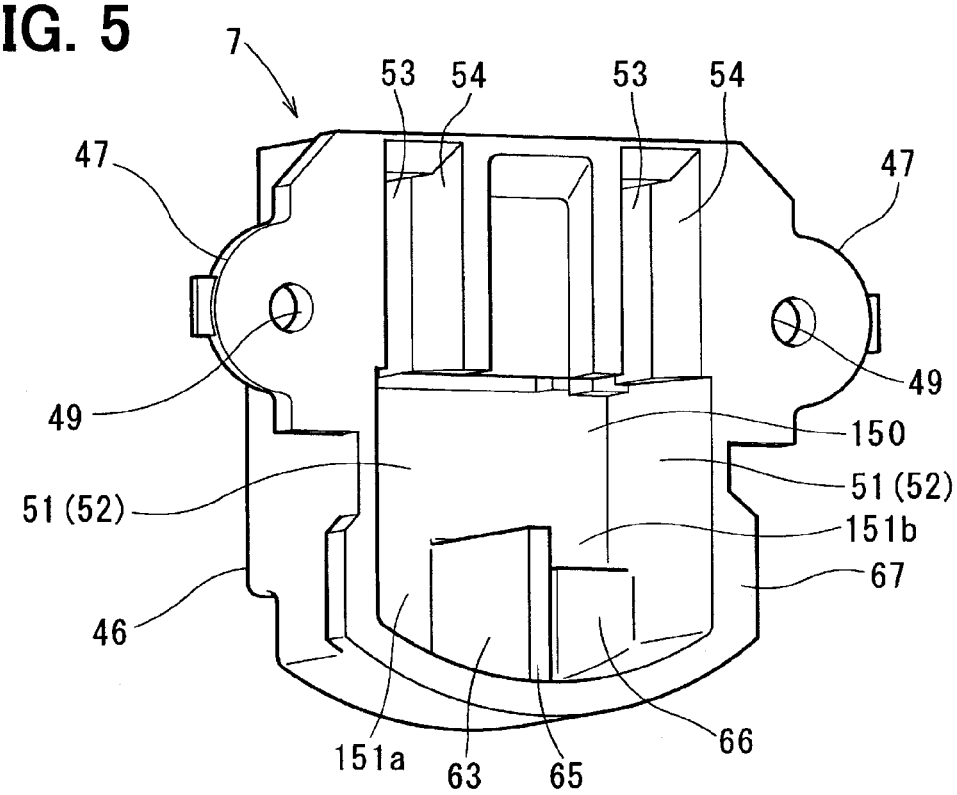
FIG. 5 is a perspective view showing a yoke contact surface of the holder of the first embodiment.
Figure 6:
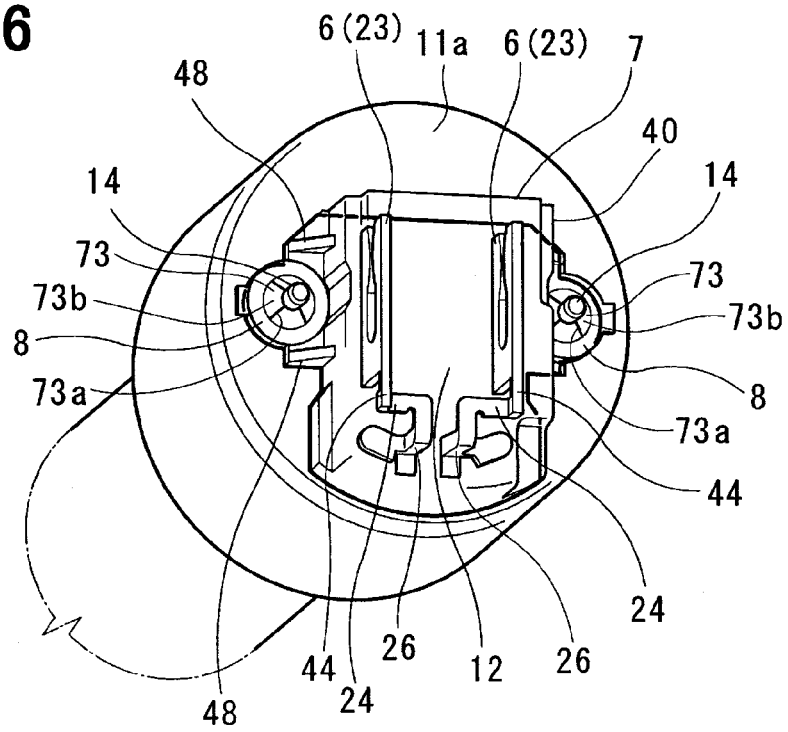
FIG. 6 is a perspective view showing the linear solenoid of the first embodiment.
Figure 7:
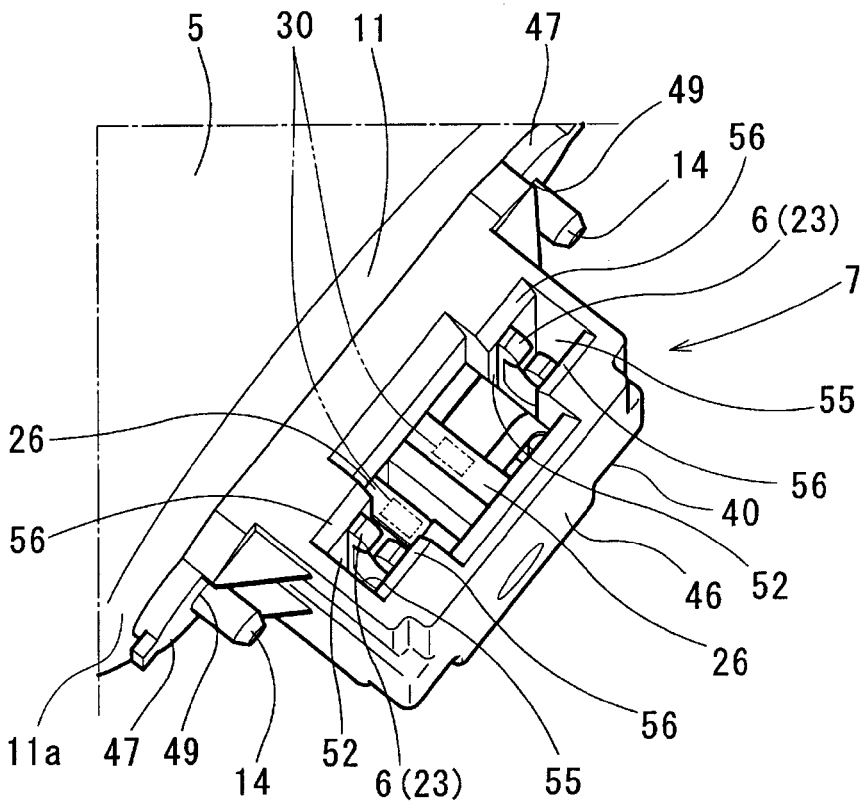
FIG. 7 is a perspective view showing planar portions of terminals of the first embodiment.
Figure 8:
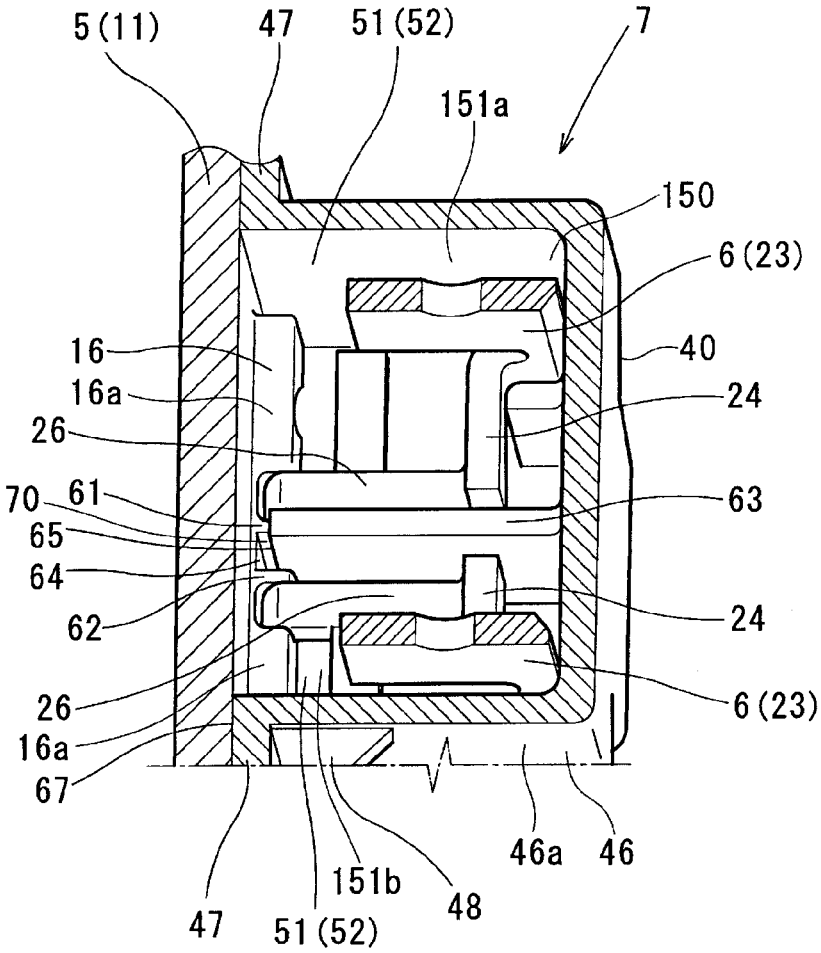
FIG. 8 is a perspective fragmented cross-sectional view showing the planar portions of the terminals of the first embodiment.
Figure 9A:
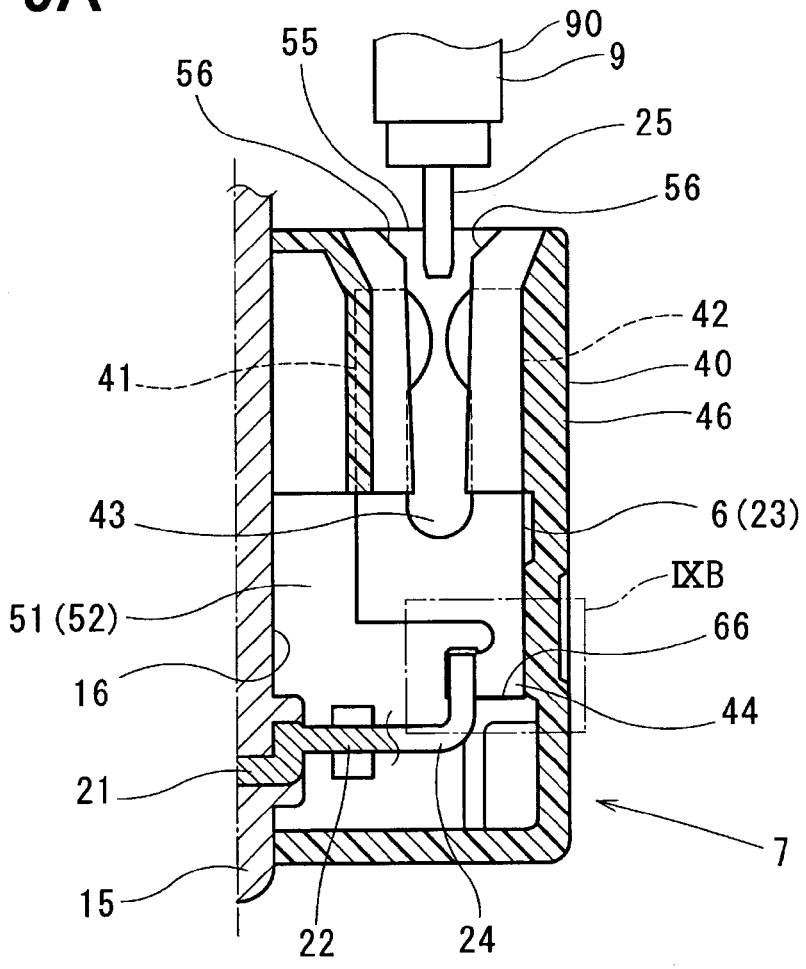
FIG. 9A is a cross-sectional view showing the terminal installed in the holder according to the first embodiment.
Figure 9B:
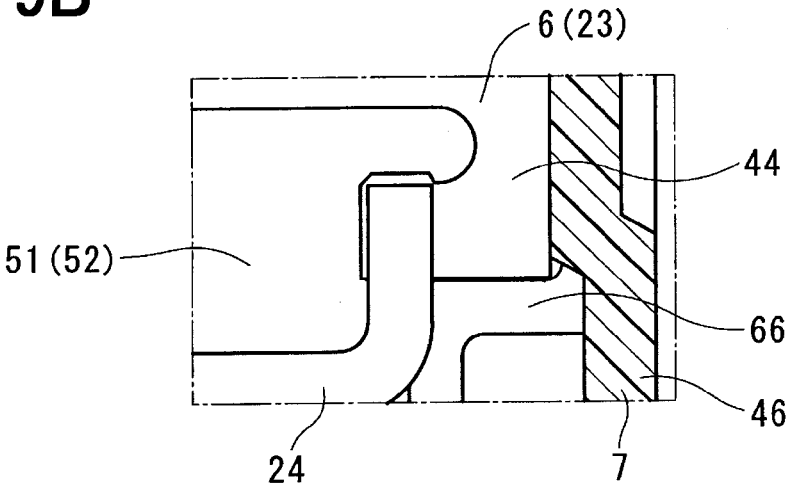
FIG. 9B is a partial enlarged view of an area IXB in FIG. 9A.
Figure 10:
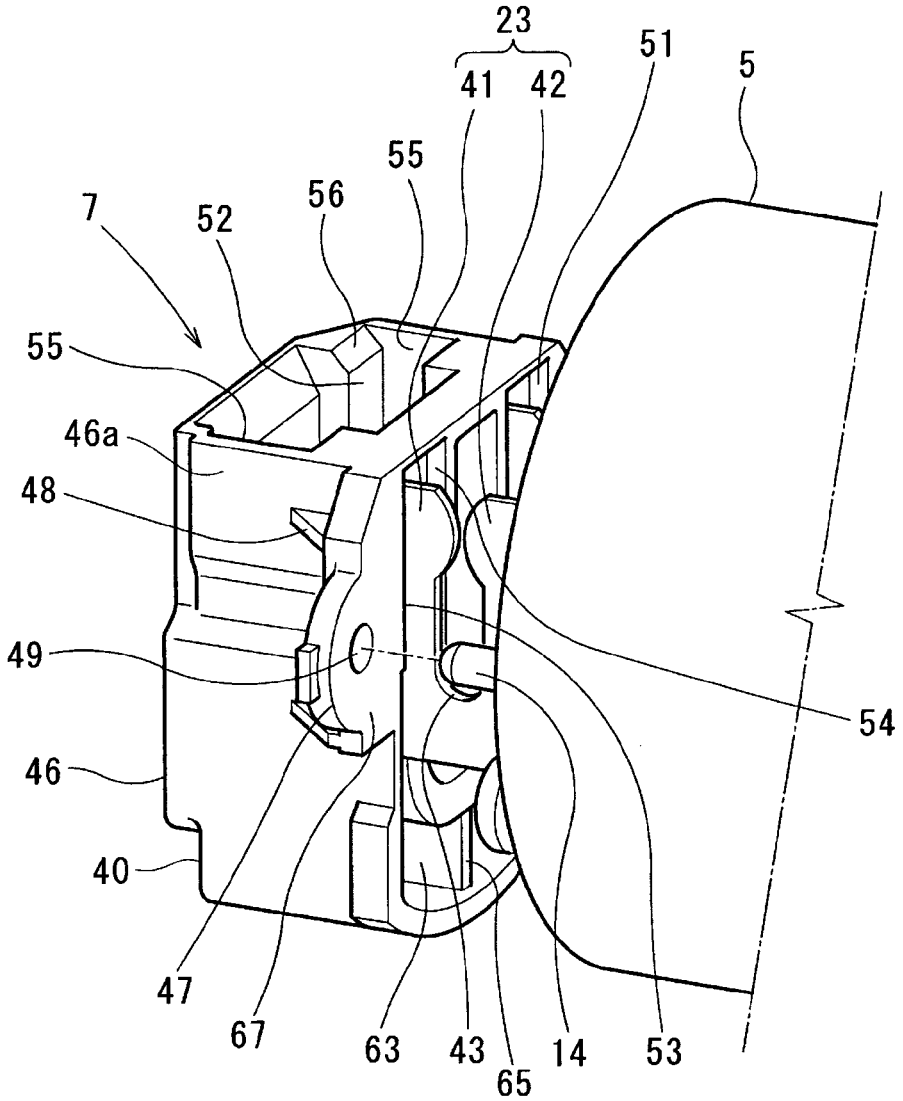
FIG. 10 is a perspective view showing a part of an assembling process of the holder to the yoke according to the first embodiment.
Figure 11:
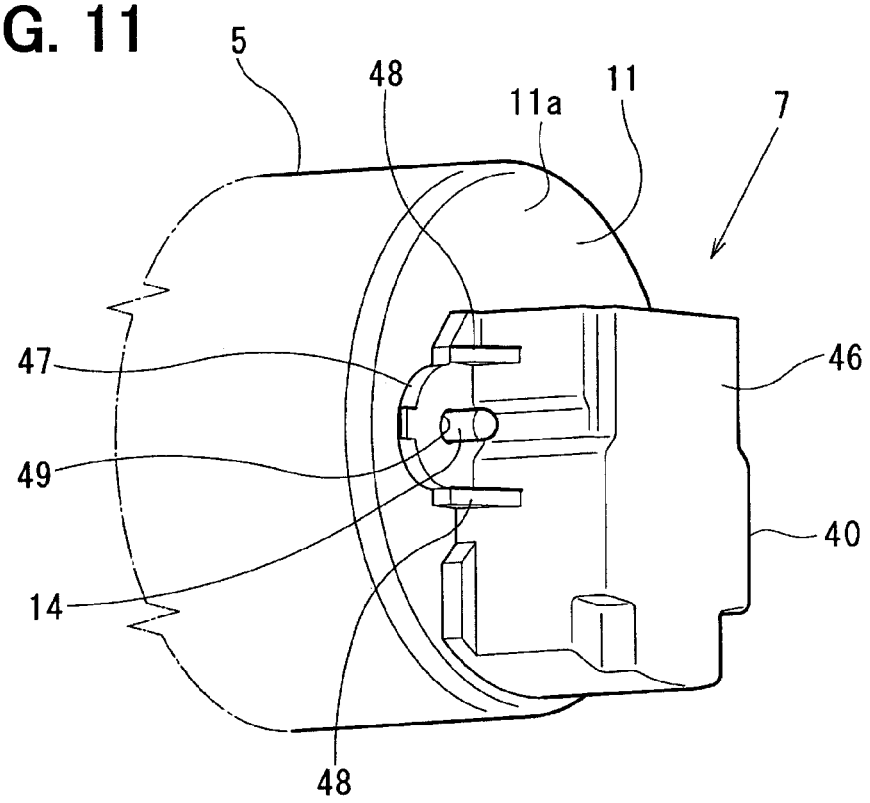
FIG. 11 is a perspective view showing another part of the assembling process of the holder to the yoke according to the first embodiment.

Alternatively, instead of forming the positioning projections 14 integrally and seamlessly with the bottom portion 11 of the yoke 5, the positioning projections 14 may be formed separately from the bottom portion 11 of the yoke 5. For example, as shown in FIG. 4B, each of the positioning projections 14 may be formed as a fitting pin 14*a*, which has a T-shaped cross section and is press fitted into a corresponding press fitting hole 11*c* formed in the bottom portion 11 of the yoke 5.

The connector 40 is for making the electrical connection of the coil 1 to the external circuit(s), such as the external electric power source and/or the external control circuit (e.g., the TCU).

The connector 40 includes the terminals 6, the terminal holder (hereinafter referred to as the holder) 7 and the fixing clips (hereinafter referred to as the clips) 8. The terminals 6 are set such that the terminals 6 project from the inside of the yoke 5 to the outside of the yoke 5 through the inside-to-outside communication hole 13. The holder 7 is installed to the outer surface 11*a* of the bottom portion 11 of the yoke 5 such that the holder 7 closes the inside-to-outside communication hole 13. Furthermore, the holder 7 (more specifically a connector case 46 of the holder 7 described later) includes a terminal receiving space 150 that is formed in an inside of the holder 7 (an inside of the connector case 46 of the holder 7). The terminal receiving space 150 includes two chamber sections (first and second chamber sections) 151*a*, 151*b*, which receive the terminals 6, respectively. Each of the chamber sections 151*a*, 151*b* includes a corresponding one of the primary terminal receiving chambers 51 and a corresponding one of the secondary terminal receiving chambers 52. The primary terminal receiving chamber 51 of each chamber section 151*a*, 151*b* receives and holds the fork terminal portion 23 of the corresponding terminal 6. Furthermore, the secondary terminal receiving chamber 52 of each chamber section 151*a*, 151*b* receives and holds the tab terminal portion 25 of a corresponding one of the external mating terminals 9 when the external mating connector 90 is connected to the connector 40. The clips 8 are used to fix the holder 7 to the outer surface 11*a* of the bottom portion 11.

Each terminal 6 is a metal conductor plate, which is made of, for example, a copper alloy or aluminum alloy and is tin plated or copper plated at its surface.

The terminals 6 are coil terminals (connector terminals) that electrically connect the coil lead lines 4 of the coil 1 to the external mating terminals 9, respectively. At the outer surface 11*a* of the bottom portion 11 of the yoke 5, the terminals 6 are set such that central axes of the fork terminal portions 23 are parallel to each other.

Each of the terminals 6 is formed by a stamping process of a metal thin plate (a metal material), which is electrically conductive, through use of, for example, a press machine. The terminal 6 includes a pre-bent portion, which is bent in a bending process that is performed simultaneously with the stamping process, and a plurality of bent portions, which are bent after the punching process.

Each terminal 6 includes the inner connection 22, the fork terminal portion 23 and the intermediate connection 24. A cross section of the inner connection 22 is configured into a rectangular form, so that the inner connection 22 has a rectangular rod form. The fork terminal portion 23 is configured into a planar plate form. A cross section of the intermediate connection 24 is configured into a rectangular form, so that the intermediate connection 24 has a rectangular rod form. Furthermore, each terminal 6 includes the base end portion 21, which is insert molded into the molding resin material (the molded resin portion 15) in the bobbin 3 after the stamping process of the terminal 6.

Each terminal 6 includes the inner connection 22, which projects from the outer surface of the molded resin portion 15 of the bobbin 3 and projects to the outside of the yoke 5 through the inside-to-outside communication hole 13 formed in the bottom portion 11 of the yoke 5. The inner connection 22 includes the lead line binding portion. The coil lead lines 4 are bound to, i.e., wound around the lead line binding portions, respectively, of the inner connections 22 of the terminals 6.

The lead line terminal end portions of the coil lead lines 4 are joined to and electrically connected to the inner connections 22, respectively, of the terminals 6 through the fusing process.

A guide groove, which is configured into a spiral form, is formed in the lead line binding portion of the inner connection 22 of each terminal 6, and the binding portion of the corresponding coil lead line 4 is spirally wound along the guide groove.

Each terminal 6 includes the intermediate connection 24 in the intermediate portion of the terminal 6, which is between the distal end portion of the inner connection 22 and a base end part 44 of the fork terminal portion 23, to integrally connect between the inner connection 22 and the fork terminal portion 23. Thereby, each terminal 6 is formed integrally as one-piece element from the single metal material from the base end to the distal end of the terminal 6.

The intermediate connection 24 includes the planar portion (a contact abutting portion) 26. The cross section of the planar portion 26 is configured into the rectangular form, and the planar portion 26 extends from the lead line bounding portion of the inner connection 22.

The fork terminal portion 23 is formed at the distal end side of each terminal 6 to connect with the tab terminal portion (a male terminal portion) 25 of the corresponding external mating terminal 9.

The fork terminal portion 23 is a connector terminal portion (a female terminal portion) that includes two clamping pieces 41, 42, each of which is configured into an arm form. The clamping pieces 41, 42 cooperate with each other to clamp the tab terminal portion 25 of the corresponding external mating terminal 9 between the clamping pieces 41, 42. The fork terminal portion 23 includes a slot 43, which is formed between the clamping pieces 41, 42 and receives the tab terminal portion 25 of the corresponding external mating terminal 9, which is inserted into the slot 43 from an opening side to a depth side of the slot 43. At the depth side of the slot 43, the base end part (a root part) 44 of the fork terminal portion 23, which is connected to the planar portion 26, is formed.

Figure 3:
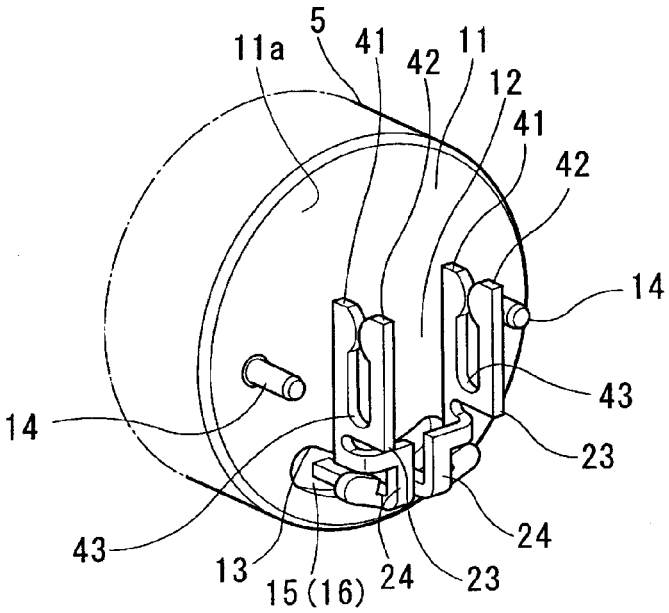
FIG. 3 is a partial perspective view showing the main feature of the linear solenoid of the first embodiment before the installation of the holder.

As shown in FIG. 3, the slot 43 opening side of the fork terminal portion 23 is directed in the inserting direction of the corresponding external mating terminal 9 (also referred to as a connector fitting direction, or a connector connecting direction), i.e., is directed in a direction that is perpendicular to the solenoid axial direction.

The holder 7 is integrally molded from the molding resin material (synthetic resin) that is dielectric. The holder 7 is fixed to, i.e., is set to the outer surface 11*a* of the bottom portion 11 after the bending process of the terminals 6.

The holder 7 includes the connector case (or simply referred to as a connector case) 46, two flanges 47, a plurality of reinforcing ribs 48 and two fitting holes 49. The connector case 46 is configured into a rectangular tubular form, and the external mating connector 90 is fitted to the connector case 46. The flanges 47 project outward from an outer surface 46*a* of the connector case 46. More specifically, each of the flanges 47 projects outward from a corresponding part of an outer surface of an outer peripheral wall of the connector case 46, which is adjacent to a corresponding one of two primary terminal insertion holes (also referred to as primary openings) 53 formed in the connector case 46, so that the flange 47 projects outward along a plane of the outer surface 11*a* of the bottom portion 11. The reinforcing ribs 48 project outward from the outer surface 46*a* of the connector case 46. More specifically, each of the reinforcing ribs 48 projects outward from the corresponding part of the outer surface of the outer peripheral wall of the connector case 46, which is adjacent to the corresponding one of two primary terminal insertion holes 53, to connect between the outer surface of the outer peripheral wall of the connector case 46 and an end surface of a corresponding one of the flanges 47. Each of the fitting holes 49 extends through a corresponding one of the flanges 47 and is fitted to an outer peripheral surface of a corresponding one of the positioning projections 14.

The primary terminal receiving chambers (primary terminal receiving holes or primary receiving recesses) 51 and the secondary terminal receiving chambers (secondary terminal receiving holes or secondary receiving recesses) 52 of the terminal receiving space 150 are formed in the inside of the connector case 46 of the holder 7. The primary terminal receiving chambers 51 receive and hold the fork terminal portions 23, respectively, of the terminals 6. The secondary terminal receiving chambers 52 receive and hold the tab terminal portions 25, respectively, of the external mating terminals 9. Each of the primary terminal receiving chambers 51 intersects with the corresponding one of the secondary terminal receiving chambers 52 at a right angle.

The primary terminal receiving chamber 51 of each of the chamber sections 151*a*, 151*b* includes the primary terminal insertion hole (the fork terminal portion insertion hole) 53, which opens at one end side. The fork terminal portion 23 of each terminal 6 is inserted into the primary terminal receiving chamber 51 of the corresponding one of the chamber sections 151*a*, 151*b* through the primary terminal insertion hole 53.

Each of the primary terminal insertion holes 53 serves as a primary opening of the present disclosure. Each primary terminal insertion hole 53 has two tapered guide surfaces (a pair of tapered guide surfaces) 54, which are opposed to each other and are tapered toward the inside of the corresponding primary terminal receiving chamber 51 (i.e., the inside of the corresponding chamber section 151*a*, 151*b*) to guide the fork terminal portion 23 of the corresponding terminal 6 to a predetermined location in the corresponding primary terminal receiving chamber 51. Specifically, in each primary terminal insertion hole 53, the tapered guide surfaces 54 are opposed to each other to form a V-shape, and a cross-sectional area of an opening defined between the guide surfaces 54 (i.e., a cross-sectional area of an opening of the primary terminal insertion hole 53) is progressively reduced from an outer opening end of the opening defined between the guide surfaces 54 toward a depth side of the opening defined between the guide surfaces 54, and an insertion path, which is configured into a rectangular shape, is formed in the bottom of the opening defined between the guide surfaces 54 to enable insertion of the fork terminal portion 23 through the insertion path. Furthermore, the number of the tapered guide surface(s) 54, which is provided to each of two sides of the primary terminal insertion hole 53 that are opposed to each other in a direction perpendicular to a longitudinal direction of the primary terminal insertion hole 53, may be one or two or more. In other words, each primary terminal insertion hole 53 may have one or more pairs of the tapered guide surfaces 54.

The secondary terminal receiving chamber 52 of each of the chamber sections 151*a*, 151*b* includes the secondary terminal insertion hole (also referred to as the tab terminal portion insertion opening or a secondary opening) 55, which opens at one end side. The tab terminal portion 25 of the corresponding external mating terminal 9 is inserted into the corresponding secondary terminal receiving chamber 52 through the secondary terminal insertion hole 55.

Each of the secondary terminal insertion holes 55 serves as a secondary opening of the present disclosure. Each secondary terminal insertion hole 55 has two tapered guide surfaces (a pair of tapered guide surfaces) 56, which are opposed to each other and are tapered toward the inside of the corresponding secondary terminal receiving chamber 52 (i.e., the inside of the corresponding chamber section 151*a*, 151*b*) to guide the tab terminal portion 25 of the corresponding external mating terminal 9 to a predetermined location in the secondary terminal receiving chamber 52. Specifically, in each secondary terminal insertion hole 55, the tapered guide surfaces 56 are opposed to each other to form a V-shape, and a cross-sectional area of an opening defined between the guide surfaces 56 (i.e., a cross-sectional area of an opening of the secondary terminal insertion hole 55) is progressively reduced from an outer opening end of the opening defined between the guide surfaces 56 toward a depth side of the opening defined between the guide surfaces 56, and an insertion path, which is configured into a rectangular shape, is formed in the bottom of the opening defined between the guide surfaces 56 to enable insertion of the tab terminal portion 25 through the insertion path. Furthermore, the number of the tapered guide surface(s) 56, which is provided to each of two sides of the secondary terminal insertion hole 55 that are opposed to each other in a direction perpendicular to a longitudinal direction of the secondary terminal insertion hole 55, may be one or two or more. In other words, each secondary terminal insertion hole 55 may have one or more pairs of the tapered guide surfaces 56.

A state of electrical conductivity of the coil 1 and the terminals 6 of the linear solenoid 100 is checked before the factory shipment of the linear solenoid valve after the completion of the assembling of the linear solenoid valve. At the time of the conductivity check, the two external test contacts 30 (see FIG. 7) of the conductivity check device (the tester) are placed to contact the planar portions (the electrode portions) 26 of the terminals 6 to check presence of the electrical conduction, a contact resistance, and/or a voltage between the terminals 6.

Each secondary terminal insertion hole 55 serves as a contact insertion hole, through which the corresponding external test contact 30 is inserted from an outside of the connector case 46 of the holder 7 (from a front side of the corresponding secondary terminal insertion hole 55) into the corresponding secondary terminal receiving chamber 52 in the fitting direction of the tab terminal portion 25 of the corresponding external mating terminal 9 relative to the fork terminal portion 23 of the corresponding terminal 6 in order to make a surface contact or a line contact of the corresponding external test contact 30 to the planar portion 26 of the corresponding terminal 6.

The bobbin projection 16 is formed in the distal end side of the molded resin portion 15 of the bobbin 3. The bobbin projection 16 is configured into the arcuate form (a partial circular ring form). The bobbin projection 16 projects to the outside of the yoke 5 through the inside-to-outside communication hole 13 by a predetermined projecting amount and also projects into the primary terminal receiving chambers 51 through the primary terminal insertion holes 53 by a predetermined projecting amount. Two fitting protrusions (projections) 61, 62 are formed at a center portion of the bobbin projection 16, which is located between the terminal projecting portions 16*a*, so that a partition wall 63 of the connector case 46 is held between the fitting protrusions 61, 62.

A plate thickness (a wall thickness) of the partition wall 63 is larger than that of each of the fitting protrusions 61, 62.

The partition wall 63 is formed in the connector case 46 to partition between the chamber sections 151*a*, 151*b* (i.e., to partition between the primary terminal receiving chambers 51 and to partition between the secondary terminal receiving chambers 52). The partition wall 63 projects from a ceiling surface of the connector case 46 of the holder 7 into the inside of the connector case 46 to partition the terminal receiving space 150 of the connector case 46 into the two parts, i.e., the chamber sections 151*a*, 151*b*. A fitting protrusion 65 is formed at a yoke 5 side end portion of the partition wall 63. The fitting protrusion 65 is fitted into a fitting groove (also referred to as a fitting recess) 64 of the bobbin projection 16.

The fitting groove 64 is formed at a corresponding location of the bobbin projection 16, which corresponds to the fitting protrusion 65 and is located between the fitting protrusions 61, 62. The fitting groove 64 forms a structure of a labyrinth (a maze) 70 between the fitting groove 64 and the fitting protrusion 65. The fitting groove 64 is recessed from projecting end surfaces of the fitting protrusions 61, 62 by a predetermined amount. The fitting groove 64 has the structure of the labyrinth (maze) 70 in a form of a U-shape (or a W-shape), which is formed by inserting the fitting protrusion 65 into the fitting groove 64.

Two ridges (reinforcing portions) 66 are formed integrally with the connector case 46 in the inside of the connector case 46. Each of the ridges 66 contacts an outer peripheral edge part (a side surface) of the fork terminal portion 23 of a corresponding one of the terminals 6 and receives a load applied to the fork terminal portion 23 of the terminal 6 at the time of fitting the external mating connector 90 to the connector case 46 of the holder 7 or at the time of fitting the tab terminal portions 25 of the external mating terminals 9 to the fork terminal portions 23 of the terminals 6. The ridges 66 are projections that project from the inner surface of the connector case 46, which forms the secondary terminal receiving chambers 52.

Furthermore, at the yoke 5 side opening end part of the connector case 46, each of the flanges 47 projects outward from the corresponding part of the outer surface of the outer peripheral wall of the connector case 46 in a direction parallel to the plane of the outer surface 11*a* of the bottom portion 11. The yoke contact surface 67 has a form of a loop (i.e., a loop that surrounds the terminal receiving space 150). The yoke contact surface 67 is formed in the end surface of the connector case 46 and the end surfaces of the flanges 47, which are opposed to the outer surface 11*a* (the holder installation seat surface 12) of the bottom portion 11 of the yoke 5, in such a manner that the yoke contact surface 67 makes a surface contact with the outer surface 11*a* (the holder installation seat surface 12) of the bottom portion 11 of the yoke 5 and surrounds the fork terminal portions 23 of the terminals 6.

A clip installation seat 68, which is configured into an annular form (a form of a loop), is formed in each of the flanges 47 on a side, which is opposite from the yoke 5 in the axial direction of the positioning projection 14. The clip installation seat 68 extends radially outward from an inner peripheral edge part of the clip installation seat 68 (a peripheral edge part of the fitting hole 49).

The clip installation seat 68 includes a recessed slope surface 69 that is located at a center portion of the clip installation seat 68 and is configured into an annular form (a form of a loop), more specifically, an inverted circular truncated cone form. The recessed slope surface 69 is a recessing tapered surface (an installation seat surface), which is tapered, i.e., is sloped in such a manner that the amount of recess of a radially-inner-side section of the recessed slope surface 69 (a radially-inner-side section of the clip installation seat 68), which is measured in a direction parallel to the axis of the corresponding positioning projection 14, is larger than the amount of recess of a radially-outer-side section of the recessed slope surface 69 (a radially-outer-side section of the clip installation seat 68 located on a radially outer side of the radially-inner-side section of the clip installation seat 68), which is measured in the direction parallel to the axis of the corresponding positioning projection 14.

Each of the flanges 47 forms a fitting portion, to which the corresponding one of the positioning projections 14 is fitted. Each of the flanges 47 has the fitting hole 49.

The reinforcing ribs 48 limit warping of the yoke contact surface 67 of the holder 7 relative to the outer surface 11*a* (the holder installation seat surface 12) of the bottom portion 11 of the yoke 5.

The fitting holes 49 of the flanges 47 are located on the outer side of the terminal receiving space 150 (i.e., the primary terminal receiving chambers 51 and the secondary terminal receiving chambers 52) of the connector case 46. Each of the fitting holes 49 is a circular hole and has an inner diameter that is slightly larger than an outer diameter of the corresponding positioning projection 14. Furthermore, the fitting hole 49 extends through a center portion of the clip installation seat 68 in a thickness direction of the clip installation seat 68, which is parallel to the axis of the positioning projection 14.

Each of the clips 8 is a resilient member (a resilient body) configured into a plate form, such as a form of a leaf spring. The clip 8 is formed through a press working process (e.g., a stamping process, a bending process) of a metal thin plate (a metal material that is a resilient material), which is made of, for example, stainless steel or spring steel.

Each of the clips 8 includes a bent portion 71, which is configured into an annular form (a form of a loop). The bent portion 71 may be bent in a bending process, which is performed simultaneously with the stamping process of the clip 8. Alternatively, the bent portion 71 may be bent in a bending process, which is performed after the stamping process of the clip 8. The bent portion 71 is a recessed bending portion, which is recessed toward the clip installation seat 68. The bent portion 71 does not contact the clip installation seat 68 during the time of press fitting the clip 8 to the positioning projection 14 and after the time of press fitting the clip 8 to the positioning projection 14.

An engaging hole 72 is formed in a center portion of each clip 8. The engaging hole 72 of the clip 8 is press fitted to the outer peripheral surface of the corresponding positioning projection 14. Each of the clips 8 includes a radially-inner-side clip portion 73, which is configured into a circular truncated cone form and is placed on a radially inner side of the bent portion 71 in the clip 8, i.e., is placed in the radially-inner-side area of the clip 8.

The engaging hole 72 of the clip 8 has an inner diameter that is smaller than an outer diameter of the positioning projection 14 in a state that is before the installation of the clip 8 to the positioning projection 14. The engaging hole 72 extends through the center portion of the radially-inner-side clip portion 73 (the center portion of the clip 8) in the thickness direction of the radially-inner-side clip portion 73 (the center portion of the clip 8), which is parallel to the axis of the positioning projection 14.

In the clip 8, the radially-inner-side clip portion 73 radially outwardly extends from a peripheral edge part of the engaging hole 72. A circular conical surface is formed in each of an outer surface and an inner surface of the radially-inner-side clip portion 73.

A plurality (four in this embodiment) of slits 73*a* (see FIG. 6) is formed in the radially-inner-side clip portion 73 of each clip 8. Each of the slits 73*a* radially outwardly extends from the peripheral edge part of the engaging hole 72. The radially-inner-side clip portion 73 is divided into a plurality (four in this embodiment) of resilient engaging pieces 73*b* by the slits 73*a*. The engaging hole 72, which has the circular cross section, is formed on the radially inner side of the radially-inner-side clip portion 73.

Furthermore, a resilient radially-inner-side engaging portion (or simply referred to as a radially-inner-side engaging portion) 74 is formed in an inner peripheral part (a peripheral edge part of the engaging hole 72) of the radially-inner-side clip portion 73. The resilient radially-inner-side engaging portion 74 is configured into an annular form (a form of a loop) and resiliently contacts the outer peripheral surface of the positioning projection 14. The resilient radially-inner-side engaging portion 74 is formed in an edge part, at which a hole wall surface of the engaging hole 72 intersects with the outer surface of the radially-inner-side clip portion 73. Specifically, the resilient radially-inner-side engaging portion 74 is formed in the inner peripheral edge part of the radially-inner-side clip portion 73.

Each of the clips 8 includes a radially-outer-side clip portion 75, which is configured into an inverted circular truncated cone form and is placed on a radially outer side of the bent portion 71 in the clip 8, i.e., is placed in the radially-outer-side area of the clip 8.

The radially-outer-side clip portion 75 is placed on a radially outer side of the radially-inner-side clip portion 73 in the clip 8. A circular conical surface is formed in each of an outer surface and an inner surface of the radially-outer-side clip portion 75.

A resilient radially-outer-side engaging portion (also simply referred to as a radially-outer-side engaging portion) 76 is configured into an annular form (a form of a loop) and is formed in an outer peripheral part (an outer peripheral edge part) of the radially-outer-side clip portion 75 (the radially-outer-side clip portion 75 serving as the radially-outer-side area of the clip 8 placed on the radially outer side of the bent portion 71). The resilient radially-outer-side engaging portion 76 resiliently contacts the recessed slope surface 69 of the clip installation seat 68 of the holder 7. The resilient radially-outer-side engaging portion 76 is an edge part, at which the outer peripheral surface of the radially-outer-side clip portion 75 intersects with the outer surface of the radially-outer-side clip portion 75. Specifically, the resilient radially-outer-side engaging portion 76 is formed in the outer peripheral edge part of the radially-outer-side clip portion 75.

The resilient radially-outer-side engaging portion 76 is a holder urging portion (also simply referred to as an urging portion) that is configured into the annular form (the form of the loop) and contacts the recessed slope surface 69 to exert an urging force that urges the yoke contact surface 67 of the holder 7 against the bottom portion 11 of the yoke 5 when the resilient radially-outer-side engaging portion 76 contacts the clip installation seat 68.

Thereby, the engaging hole 72 of each of the clips 8 is press fitted to the outer peripheral surface of the positioning projection 14 after the fitting of the fitting holes 49 of the holder 7 to the positioning projections 14. Thus, the diameter of the engaging hole 72, which is located at the distal end side of the radially-inner-side clip portion 73, is enlarged, and the radially-inner-side clip portion 73 and the radially-outer-side clip portion 75 are resiliently deformed in an application direction of a press fitting load (see arrows in FIG. 1A). As a result, the holder 7 can be fixed such that the yoke contact surface 67 of the holder 7 tightly contacts against the outer surface 11*a* (the holder installation seat surface 12) of the bottom portion 11 of the yoke 5 along the entire perimeter of the yoke contact surface 67 of the holder 7.

Figure 1B:
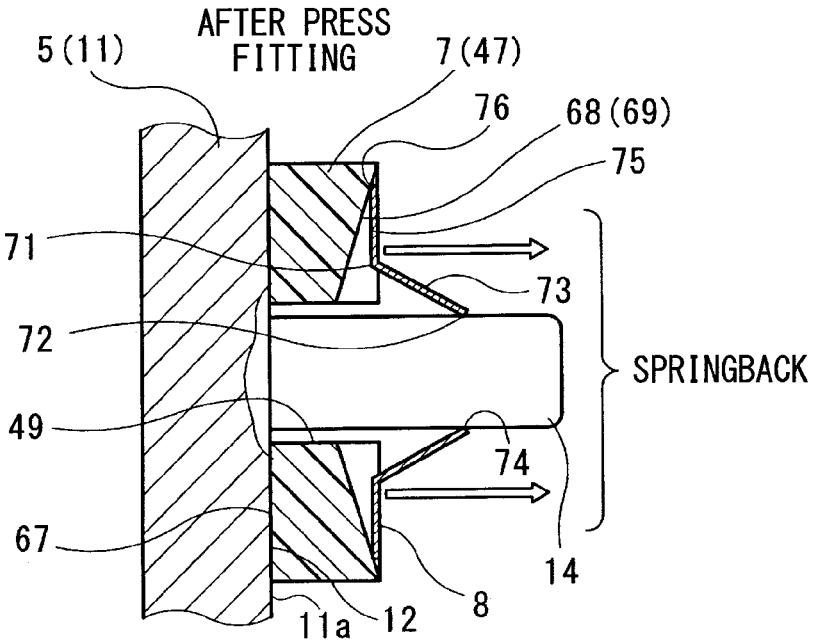
FIG. 1B is a descriptive diagram showing another state of the clip after the press fitting of the clip shown in FIG. 1A.
Figure 2:
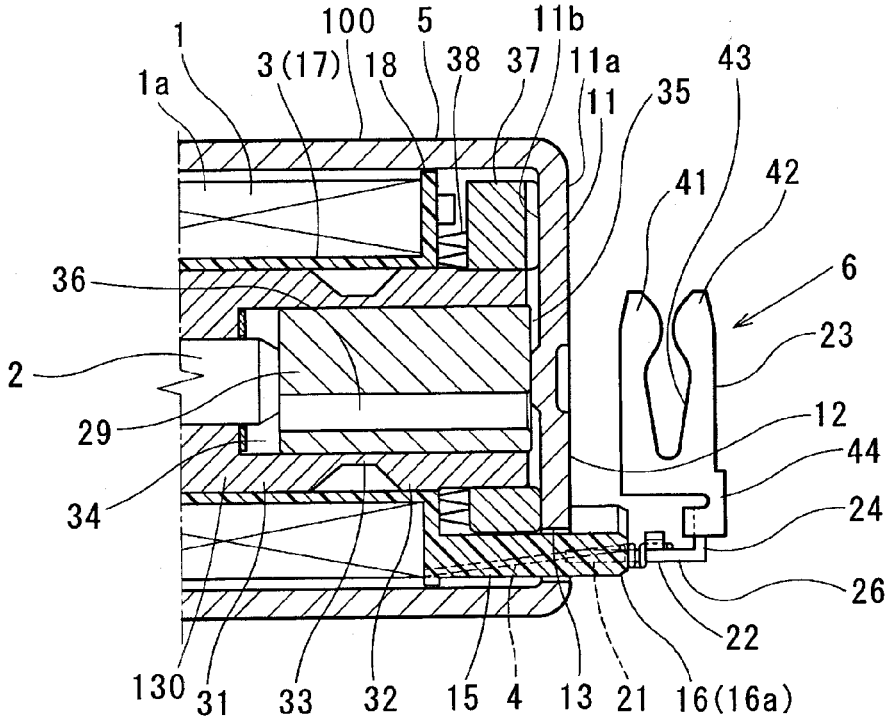
FIG. 2 is a partial cross sectional view showing a main feature of a linear solenoid of the first embodiment before installation of a holder.

As shown in FIG. 1A, at the time of applying the press fitting load against the radially-outer-side clip portion 75 of the clip 8, i.e., at the time of press fitting the clip 8 to the positioning projection 14, the radially-outer-side clip portion 75 is resiliently deformed into the inverted circular truncated cone form. Furthermore, as shown in FIG. 1B, after completion of the application of the press fitting load against the radially-outer-side clip portion 75 of the clip 8, i.e., after completion of the press fitting of the clip 8 to the positioning projection 14, the radially-outer-side clip portion 75 becomes the circular annular plate form, which is generally parallel to the outer surface 11*a* (the holder installation seat surface 12) of the bottom portion 11 of the yoke 5. That is, the radially-outer-side clip portion 75 is released from the press fitting load and is resiliently bent backward in a direction of arrows indicated in FIG. 1B, so that the plane of the radially-outer-side clip portion 75 is generally perpendicular to the axis of the positioning projection 14.

Next, a procedure of fixing the holder 7 to the outer surface 11*a* (the holder installation seat surface 12) of the bottom portion 11 of the yoke 5 of the linear solenoid 100 according to an assembling method of the present embodiment will be described.

At the time, which is before the press fitting of the clips 8 to the positioning projections 14 formed integrally with the bottom portion 11 of the yoke 5 of the linear solenoid 100, the fitting holes 49 of the flanges 47 of the holder 7 are aligned with the distal end parts, respectively, of the positioning projections 14 and are pushed toward the base end side of the positioning projections 14 along the outer peripheral surfaces of the positioning projections 14. That is, the fitting hole 49 of each flange 47 is pushed toward the base end side of the positioning projection 14 until the yoke contact surface 67 of the connector case 46 and of the flanges 47 contacts the outer surface 11*a* (the holder installation seat surface 12) of the bottom portion 11 of the yoke 5. In this way, the fitting holes 49 of the holder 7 are fitted to the positioning projections 14.

At this time, since the positioning projections 14 are formed in the holder installation seat surface 12, which is the predetermined location of the outer surface 11*a* of the bottom portion 11 of the yoke 5, the holder 7, which includes the connector case 46 and the flanges 47, is temporarily installed to the predetermined location of the outer surface 11*a* (the holder installation seat surface 12) of the bottom portion 11 of the yoke 5 (a first assembling process).

Next, each clip 8 is installed such that the press fitting load is applied to the clip 8 in the state where the engaging hole 72 of the clip 8 is aligned to the distal end portion of the positioning projection 14. Thereby, the engaging hole 72 of the clip 8 is press fitted to the outer peripheral surface of the positioning projection 14, which projects from the recessed slope surface 69 of the clip installation seat 68 of the flange 47 of the holder 7. Then, the radially-inner-side part (the distal end part) of the radially-inner-side clip portion 73 of each of the clips 8 resiliently contacts the outer peripheral surface of the corresponding one of the positioning projections 14. At this time, since the engaging hole 72, which is located on the radially inner side of the radially-inner-side clip portion 73, has the inner diameter, which is smaller than the outer diameter of the positioning projection 14 in the state before the installation of the clip 8 to the positioning projection 14, the radially-inner-side clip portion 73 is press fitted to the outer peripheral surface of the positioning projection 14 in such a manner that the inner diameter of the radially-inner-side clip portion 73 is increased upon installation of the clip 8 to the positioning projection 14.

The resilient force, which urges the yoke contact surface 67 of the holder 7 against the holder installation seat surface 12 of the bottom portion 11 of the yoke 5, is increased in the resilient radially-outer-side engaging portion 76 of the radially-outer-side clip portion 75 at the clip 8 in response to the resilient deformation of the radially-inner-side clip portion 73. The resilient force is exerted in a direction that is parallel to the application direction of the press fitting load (see arrows in FIG. 1A), i.e., is exerted in a perpendicular direction that is perpendicular to the holder installation seat surface 12 of the yoke 5 and the yoke contact surface 67 of the holder 7.

In this way, the yoke contact surface 67 of the holder 7 is urged against the holder installation seat surface 12 of the bottom portion 11 of the yoke 5 by the resilient forces of the clips 8. Thereby, the yoke contact surface 67 of the holder 7 tightly contacts the holder installation seat surface 12 of the bottom portion 11 of the yoke 5 along the entire perimeter of the yoke contact surface 67, so that the holder 7 is fixed to the bottom portion 11 of the yoke 5. That is, the holder 7 is assembled to the holder installation seat surface 12 of the bottom portion 11 of the yoke 5 through use of the resilient forces of the clips 8 (a finalized installation process).

At this time, each terminal 6, particularly the fork terminal portion 23 of the terminal 6, which is held by the molded resin portion 15 of the bobbin 3 in the state where the terminal 6 projects from the holder installation seat surface 12 of the bottom portion 11 of the yoke 5 to the outside of the yoke 5 through the inside-to-outside communication hole 13, is guided into the primary terminal receiving chamber 51 of the corresponding chamber section 151*a*, 151*b* by the tapered guide surfaces 54 of the corresponding primary terminal insertion hole 53.

At the time of assembling the holder 7 to the holder installation seat surface 12 of the bottom portion 11 of the yoke 5, even in a case where the position of the fork terminal portion 23 of the terminal 6 is deviated relative to the primary terminal receiving chamber 51, the fork terminal portion 23 is guided to the center portion between the tapered guide surfaces 54 of the primary terminal insertion hole 53 by the tapered guide surfaces 54. In this way, the fork terminal portion 23 of each terminal 6 is guided to the center portion (an appropriate position, i.e., a designated position) in the corresponding primary terminal receiving chamber 51, so that the connection state between the fork terminal portion 23 of the terminal 6 and the tab terminal portion 25 of the corresponding external mating terminal 9 is stabilized.

Now, advantages of the first embodiment will be described.

As discussed above, in the linear solenoid 100 of the linear solenoid valve of the present embodiment, the holder 7 is temporarily installed to the predetermined location of the outer surface 11*a* (the holder installation seat surface 12) of the bottom portion 11 of the yoke 5 by fitting the flanges 47, each of which projects outward from the corresponding part of the outer surface of the outer peripheral wall of the connector case 46 at the location adjacent to the corresponding primary terminal insertion hole 53 formed in the connector case 46, to the outer peripheral surfaces of the positioning projections 14, respectively.

The holder 7 has the yoke contact surface 67, which makes the surface contact with the holder installation seat surface 12 of the bottom portion 11 of the yoke 5 at the time of press fitting the clips 8 to the positioning projections 14. The yoke contact surface 67 is configured into the form of the loop (ring) to surround the fork terminal portions 23 of the terminals 6, which are received and held in the primary terminal receiving chambers 51 of the holder 7.

In the holder 7, the clip installation seat 68 is formed in each flange 47 to extend radially outward from the peripheral edge part of the fitting hole 49, which is fitted to the corresponding positioning projection 14. The recessed slope surface 69 is formed at the clip installation seat 68 of each flange 47. The recessed slope surface 69 is configured into the annular form (the inverted circular truncated cone form) and is sloped in such a manner that the amount of recess of the radially-inner-side section of the recessed slope surface 69 is larger than the amount of recess of the radially-outer-side section of the recessed slope surface 69.

The clips 8 are fitted to the outer peripheral surfaces of the positioning projections 14, respectively, to fix the holder 7 to the holder installation seat surface 12 of the bottom portion 11 of the yoke 5. At this time, the clips 8 are respectively installed to the positioning projections 14 such that the yoke contact surface 67 of the holder 7 tightly contacts the holder installation seat surface 12 of the bottom portion 11 of the yoke 5.

In each of the clips 8, the radially-inner-side clip portion 73 is formed on the radially inner side of the bent portion 71, and the radially-outer-side clip portion 75 is formed on the radially outer side of the bent portion 71.

The resilient radially-inner-side engaging portion 74, which is configured into the annular form and resiliently contacts the outer peripheral surface of the positioning projection 14, is formed in the inner peripheral part of the radially-inner-side clip portion 73 (the radially-inner-side clip portion 73 serving as a radially-inner-side area of the clip 8 placed on the radially inner side of the bent portion 71). Furthermore, the resilient radially-outer-side engaging portion 76, which resiliently contacts the recessed slope surface 69 of the clip installation seat 68, is formed in the outer peripheral part of the radially-outer-side clip portion 75.

The resilient radially-outer-side engaging portion 76 serves as the holder urging portion (or simply referred to as the urging portion), which contacts the recessed slope surface 69 of the clip installation seat 68 to exert the urging force that urges the yoke contact surface 67 of the holder 7 against the bottom portion 11 of the yoke 5. Thereby, only the radially-inner-side clip portion 73 is largely flexed about the radially-outer-side clip portion 75 at the time of press fitting the clip 8 to the positioning projection 14. In this way, occurrence of springback of the radially-outer-side clip portion 75 is prevented or limited. Thus, occurrence of lifting of the resilient radially-outer-side engaging portion 76 from the clip installation seat 68 of the holder 7 can be prevented or limited.

Thereby, the yoke contact surface 67 of the holder 7 can tightly contact the outer surface 11*a* (the holder installation seat surface 12) of the bottom portion 11 of the yoke 5 without forming a gap (a clearance) along the entire perimeter of the yoke contact surface 67 of the holder 7. Thus, intrusion of the foreign object into the space (e.g., the terminal receiving space 150), which is defined between the connector case 46 of the holder 7 and the outer surface 11*a* of the bottom portion 11 of the yoke 5 can be limited. Thus, it is possible to limit occurrence of intrusion of the foreign object from the outside of the yoke 5 into this space and occurrence of intrusion of the foreign object from this space into the inside of the yoke 5 through the inside-to-outside communication hole 13. That is, the intrusion of the foreign object into the inside of the yoke 5 can be limited.

Furthermore, the resilient radially-outer-side engaging portion 76, which is configured into the annular form, is formed in the radially-outer-side clip portion 75 of the clip 8. The resilient radially-outer-side engaging portion 76 resiliently contacts the recessed slope surface 69 of the clip installation seat 68 and exerts the resilient force to urge the yoke contact surface 67 of the holder 7 against the outer surface 11*a* of the bottom portion 11 of the yoke 5.

Thereby, the yoke contact surface 67 of the holder 7 can tightly contact the outer surface 11*a* (the holder installation seat surface 12) of the bottom portion 11 of the yoke 5 without forming the clearance along the entire perimeter of the yoke contact surface 67 of the holder 7. Thus, the intrusion of the foreign object into the space, which is defined between the holder 7 and the yoke 5, can be limited.

Furthermore, the reinforcing ribs 48 are formed in the connector case 46 of the holder 7. The reinforcing ribs 48 limit the warping of the yoke contact surface 67 of the holder 7 relative to the outer surface 11*a* (the holder installation seat surface 12) of the bottom portion 11 of the yoke 5. The reinforcing ribs 48 project outward from the outer surface 46*a* of the connector case 46. Each reinforcing rib 48 is configured into a triangular form to connect between the outer surface 46*a* of the connector case 46 and the corresponding flange 47, which projects outward from the outer surface 46*a* of the connector case 46 and includes the clip installation seat 68.

Thereby, the contact tightness between the outer surface 11*a* (the holder installation seat surface 12) of the bottom portion 11 of the yoke 5 and the yoke contact surface 67 of the holder 7 can be improved. Thus, the yoke contact surface 67 of the holder 7 can tightly contact the holder installation seat surface 12 of the bottom portion 11 of the yoke 5 along the entire perimeter of the yoke contact surface 67 without forming the clearance between the yoke contact surface 67 of the holder 7 and the holder installation seat surface 12 of the bottom portion 11 of the yoke 5. As a result, it is possible to limit the intrusion of the foreign object into the space, which is defined between the holder 7 and the bottom portion 11 of the yoke 5. Thereby, it is possible to limit the intrusion of the foreign object into the inside of the yoke 5 through the inside-to-outside communication hole 13.

Furthermore, the holder 7 includes the primary terminal insertion holes 53 and the secondary terminal insertion holes 55. At the time of assembling the holder 7 to the outer surface 11*a* (the holder installation seat surface 12) of the bottom portion 11 of the yoke 5, the fork terminal portions 23 of the terminals 6 are respectively inserted into the primary terminal receiving chambers 51 through the primary terminal insertion holes 53. At the time of fitting the tab terminal portions 25 of the external mating terminals 9 to the fork terminal portions 23 of the terminals 6, the tab terminal portions 25 are respectively inserted into the secondary terminal receiving chambers 52 through the secondary terminal insertion holes 55.

The tapered guide surfaces 54 are formed in each primary terminal insertion hole 53 to guide the fork terminal portion 23 of the corresponding terminal 6 to the predetermined location in the corresponding primary terminal receiving chamber 51.

Thereby, in the process of assembling the holder 7 to the yoke 5, even when the positional deviation occurs between the fork terminal portion 23 of the terminal 6 and the primary terminal insertion hole 53 of the holder 7 at the time of inserting the fork terminal portion 23 into the primary terminal receiving chamber 51 of the holder 7, the fork terminal portion 23 of the terminal 6 is guided to and is placed to the corresponding position, at which the fork terminal portion 23 contacts the tapered guide surface(s) 54 of the holder 7, rather than the position, at which the fork terminal portion 23 contacts the yoke contact surface (a seal surface) 67 of the holder 7. In this way, it is possible to eliminate or limit occurrence of a damage (e.g., a scratch) on the yoke contact surface 67 of the holder 7 caused by contact of the fork terminal portion 23 to the yoke contact surface 67 of the holder 7. Thereby, it is possible to achieve a required fluid-tightness (flatness and/or smoothness) between the yoke contact surface 67 of the holder 7 and the outer surface 11*a* (the holder installation seat surface 12) of the bottom portion 11 of the yoke 5.

Furthermore, the provision of the tapered guide surfaces 54 to each primary terminal insertion hole 53 of the connector case 46 of the holder 7 enables easy guidance (insertion) of the fork terminal portion 23 to the predetermined location in the corresponding primary terminal receiving chamber 51. Thus, at the time of assembling the holder 7 to the yoke 5, the insertability of the fork terminal portion 23 of the terminal 6 into the corresponding primary terminal receiving chamber 51 of the holder 7 can be improved.

Furthermore, the provision of the tapered guide surfaces 56 to each secondary terminal insertion hole 55 of the connector case 46 of the holder 7 enables easy guidance (insertion) of the tab terminal portion 25 of the external mating terminal 9 to the predetermined location (i.e., the slot 43 of the corresponding fork terminal portion 23) in the corresponding secondary terminal receiving chamber 52. Thereby, at the time of fitting the external mating connector 90 to the connector case 46 of the holder 7 or at the time of fitting the tab terminal portion 25 of the external mating terminal 9 to the fork terminal portion 23 of the terminal 6, the insertability of the tab terminal portion 25 of the external mating terminal 9 into the slot 43 of the fork terminal portion 23 of the corresponding terminal 6 can be improved.

Furthermore, the molded resin portion 15 (e.g., the bobbin projection 16, i.e., the terminal support portion that is integrated with the bobbin 3) is provided. The portions of the coil lead lines 4 of the coil 1 and the base end portions 21 of the terminals 6 are embedded into and are supported by the molded resin portion 15.

The molded resin portion 15 projects outward from the outer surface 11*a* (the holder installation seat surface 12) of the bottom portion 11 of the yoke 5.

The holder 7 and the molded resin portion 15 are made of the synthetic resin, which is dielectric. The partition wall 63 is provided at the holder 7 and the molded resin portion 15 to partition between the chamber sections 151*a*, 151*b* (i.e., to partition between the primary terminal receiving chambers 51 and to partition between the secondary terminal receiving chambers 52).

In the linear solenoid 100 of the present embodiment, the fitting protrusions 61, 62, the partition wall 63, the fitting groove 64, and the fitting protrusion 65 are provided in the bobbin projection 16 and the connector case 46 of the holder 7 to partition between the chamber sections 151*a*, 151*b* (i.e., to partition between the primary terminal receiving chambers 51 and to partition between the secondary terminal receiving chambers 52), so that it is possible to limit the intrusion of the electrically conductive foreign object into the inside of the connector case 46 of the holder 7 (the primary terminal receiving chambers 51 and the secondary terminal receiving chambers 52) or to limit generation of whiskers (i.e., small metal hairs or tendrils generated through a process of a crystal growth on a surface of a plated metallic surface) at the electrical connection between the fork terminal portion 23 of the terminal 6 and the tab terminal portion 25 of the external mating terminal 9.

The structure of the labyrinth (maze) 70, which is configured into, for example, the U-shape, is formed between the fitting groove 64, which is formed in the bobbin projection 16 of the bobbin 3, and the fitting protrusion 65, which is formed in the yoke 5 side end portion of the partition wall 63 that partitions the inside space of the connector case 46 of the holder 7 into the two parts. The labyrinth 70 is formed by inserting the fitting protrusion 65 into the fitting groove 64. In this way, the intrusion of the electrically conductive foreign object into the labyrinth 70, which is formed between the fitting groove 64 and the fitting protrusion 65, becomes difficult, and the passing of the electrically conductive foreign object through the labyrinth 70 becomes difficult. Thus, it is possible to eliminate or limit a possibility of short circuiting between the adjacent fork terminal portions 23 or short circuiting between the adjacent tab terminal portions 25 caused by presence of the electrically conductive foreign object, which bridges between the adjacent fork terminal portions 23 or between the adjacent tab terminal portions 25.

The fork terminal portion 23 of the terminal 6 may possibly be plastically deformed at the time of fitting the tab terminal portion 25 to the fork terminal portion 23 of the terminal 6. Thus, there is a limitation with respect to the number of installations and detachments of the tab terminal portion 25 relative to the fork terminal portion 23. Therefore, at the time of performing the conductivity check during the factory shipment of the linear solenoid valve, it is not desirable to perform a conductivity check, which is similar to a conductivity check performed on the linear solenoid valve installed in the vehicle, i.e., it is not desirable to perform a conductivity check by contacting the external test contacts of the conductivity check device (the tester) to the fork terminal portions 23 of the terminals 6.

Furthermore, some of the previously proposed connector products are formed such that two contact insertion holes (through holes) are formed in a side surface of a connector case to expose the terminals. In this instance, the external test contacts of the conductivity check device (the tester) are inserted into the contact insertion holes to contact the external test contacts to subject contacting portions (e.g., intermediate connections) of the terminals to perform the conductivity check. In such a case, the conduction of the electricity through the terminals at the time of performing the conductivity check is easy.

However, in the linear solenoid 100 of the present embodiment, in order to limit the intrusion of the foreign objects, the openings (contact insertion holes) are not formed in the side surface of the connector case 46 of the holder 7, so that the exposure of the intermediate connections 24 is limited. Therefore, the conduction of the electricity through the terminals at the time of performing the conductivity check may possibly be difficult.

In the holder 7 of the linear solenoid valve of the present embodiment, the dedicated contact insertion holes are not formed in the side surface of the connector case 46, and the secondary terminal insertion holes 55 are used as the contact insertion holes, through which the external test contacts 30 of the conductivity check device (the tester) are inserted from the outside of the connector case 46 to the planar portions 26 of the terminals 6.

In this way, the conductivity check, which is different from the conductivity check performed on the linear solenoid valve installed on the vehicle, can be performed at the time of factory shipment of the linear solenoid valve. That is, the conductivity check is eased. As a result, the state of electrical conductivity of the linear solenoid valve can be easily checked without deteriorating the advantage of limiting the intrusion of the foreign object. Thus, the malfunction of the linear solenoid valve, which is caused by the intrusion of the foreign object, can be advantageously limited.

The ridges 66 are formed in the inner surface of the connector case 46 of the holder 7. Each of the ridges 66 contacts the fork terminal portion 23 of the corresponding one of the terminals 6 and receives the load (the press fitting load, the urging load) applied to the fork terminal portion 23 of the terminal 6 at the time of fitting the external mating connector 90 to the connector case 46 of the holder 7 or at the time of fitting the tab terminal portions 25 of the external mating terminals 9 to the fork terminal portions 23 of the terminals 6.

Thereby, at the time of fitting the external mating connector 90 to the connector case 46 of the holder 7 or at the time of fitting the tab terminal portions 25 of the external mating terminals 9 to the fork terminal portions 23 of the terminals 6, the ridges 66 of the holder 7 contact the base end parts 44 of the fork terminal portions 23 of the terminals 6 to disperse the fitting load, which is applied to the fork terminal portions 23 of the terminals 6, to the ridges 66 of the holder 7. Therefore, it is possible to limit a damage or malfunction of the fork terminal portions 23 of the terminals 6.

Furthermore, the connection (fitting connection) between the fork terminal portion 23 of the terminal 6 and the tab terminal portion 25 of the external mating terminal 9 can limit enlargement of a gap, which is formed between the fork terminal portion 23 of the terminal 6 and the tab terminal portion 25 of the external mating terminal 9. In this way, it is possible to limit the intrusion of the foreign object into this gap.

The linear solenoid 100 of the present embodiment enables the provision of the planar portion 26 in the intermediate connection 24, which is located between the inner connection 22 and the fork terminal portion 23 in the terminal 6, through the bending process. Also, the fork terminal portion 23 can be provided in a desirable location in the terminal 6 through the bending process.

Furthermore, the above described structure is entirely provided in the space, which is defined (enclosed) by the yoke 5, the holder 7 and the external mating terminals 9.

Figure 14:
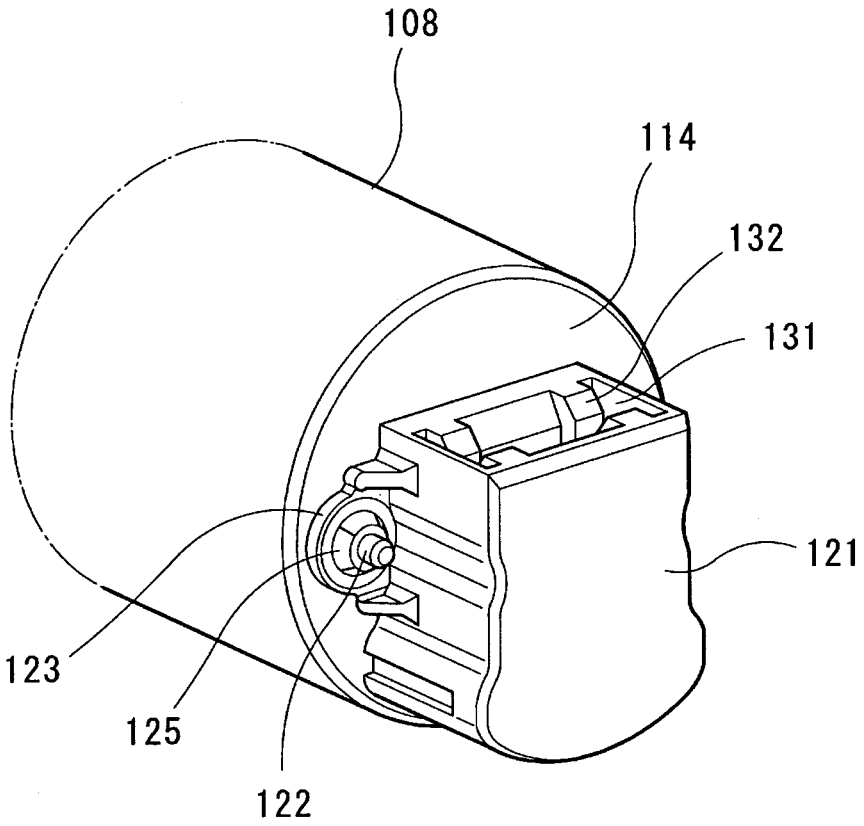
FIG. 14 RELATED ART
FIG. 14 is a perspective view showing a linear solenoid of a comparative example.
Figure 15A:
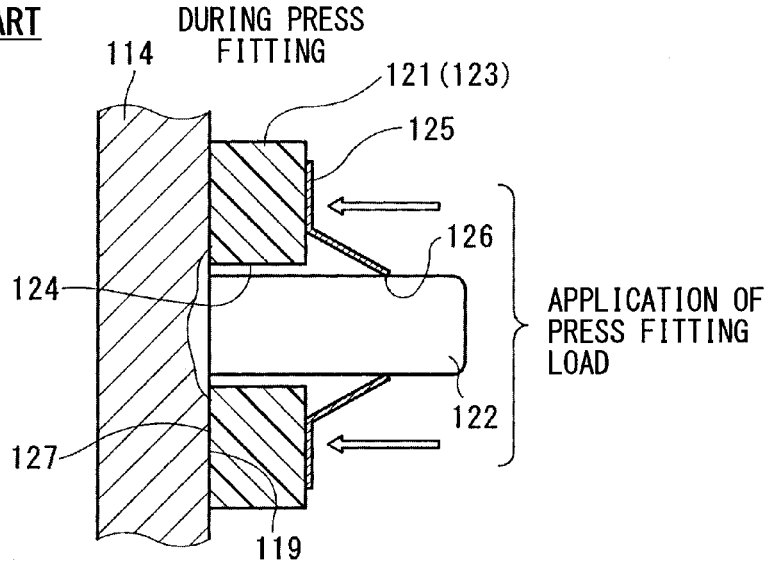
FIG. 15A RELATED ART
FIG. 15A is a descriptive diagram showing a state of a clip at a time of press fitting the clip in the comparative example.
Figure 15B:
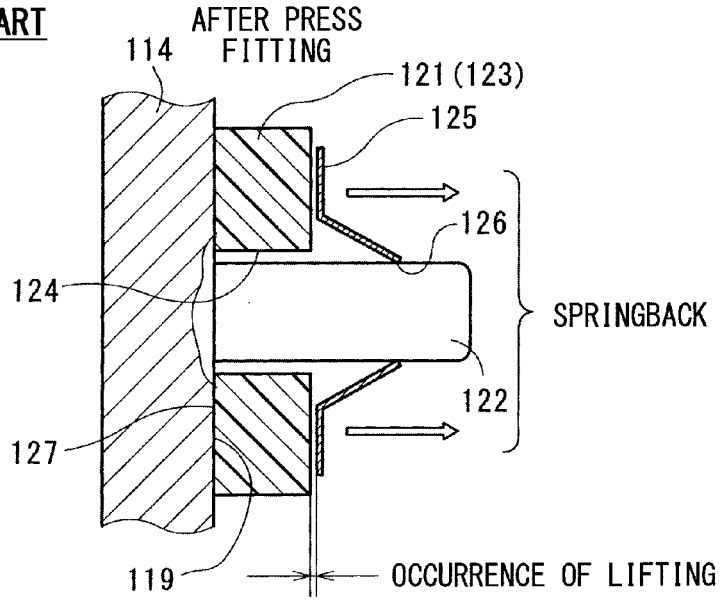
FIG. 15B RELATED ART
FIG. 15B is a descriptive diagram showing another state of the clip after the press fitting of the clip shown in FIG. 15A.

In the linear solenoid of the comparative example, as shown in FIGS. 14 to 15B, the clearance is formed between the flange 123 and the clip 125. Therefore, when the vibrations of the vehicle and/or the engine are conducted to the yoke 108, the outer peripheral surface of each positioning projection 122 and the hole wall surface of the fitting hole 124 of the flange 123 are repeatedly slid relative to each other to cause generation of a friction.

This may possibly cause a change (reduction) in a cross-sectional area of the positioning projection 122 and/or a change (increase) in a hole shape of the fitting hole 124 to possibly cause a positional deviation of the holder 121 relative to the predetermined position of the outer surface (e.g., the holder installation seat surface 119) of the bottom portion 114 of the yoke 108. Thereby, due to the wearing of the positioning projection 122 and/or the wearing of the fitting hole 124, the reliability with respect of the installation of the holder 121 may possibly be deteriorated, and the reliability of the electric conductivity at the fork terminal portion of the terminal may possibly be deteriorated.

In view of the above disadvantages, in the linear solenoid 100 of the present embodiment, the above-described structure is implemented to limit the deterioration of the reliability with respect of the installation of the holder 7 to the predetermined location of the outer surface 11*a* (the holder installation seat surface 12) of the bottom portion 11 of the yoke 5 and the deterioration of the reliability of the electric conductivity between the tab terminal portion 25 of each external mating terminal 9 and the fork terminal portion 23 of the corresponding terminal 6 caused by the wearing of the outer peripheral surfaces of the positioning projections 14 and/or the wearing of the hole wall surfaces of the fitting holes 49 of the flanges 47.

Specifically, the recessed slope surface 69, which is configured into the annular form (the inverted circular truncated cone form), is formed in the clip installation seat 68 of each flange 47 of the holder 7, and the resilient radially-inner-side engaging portion 74, which is configured into the annular form and resiliently contacts the outer peripheral surface of the corresponding positioning projection 14, is formed in the inner peripheral part of the radially-inner-side clip portion 73 of each clip 8. Furthermore, the resilient radially-outer-side engaging portion 76, which resiliently contacts the recessed slope surface 69 of the clip installation seat 68, is formed in the outer peripheral part of the radially-outer-side clip portion 75 of each clip 8.

Furthermore, the resilient radially-outer-side engaging portion 76 of each clip 8 is formed as the holder urging portion, which urges the yoke contact surface 67 of the holder 7 against the holder installation seat surface 12 of the bottom portion 11 of the yoke 5. In this way, the lifting of the resilient radially-outer-side engaging portion 76 of the clip 8 from the clip installation seat 68 of the holder 7 after the press fitting of the clip 8 to the outer peripheral surface of the positioning projection 14 can be advantageously prevented or limited.

Thereby, in the linear solenoid 100 of the present embodiment, it is possible to limit the deterioration of the reliability with respect of the installation of the holder 7 to the predetermined location of the outer surface 11*a* (the holder installation seat surface 12) of the bottom portion 11 of the yoke 5 and the deterioration of the reliability of the electric conductivity between the tab terminal portion 25 of each external mating terminal 9 and the fork terminal portion 23 of the corresponding terminal 6 caused by the wearing of the outer peripheral surfaces of the positioning projections 14 and/or the wearing of the hole wall surfaces of the fitting holes 49 of the flanges 47.

Second Embodiment

Figure 12:
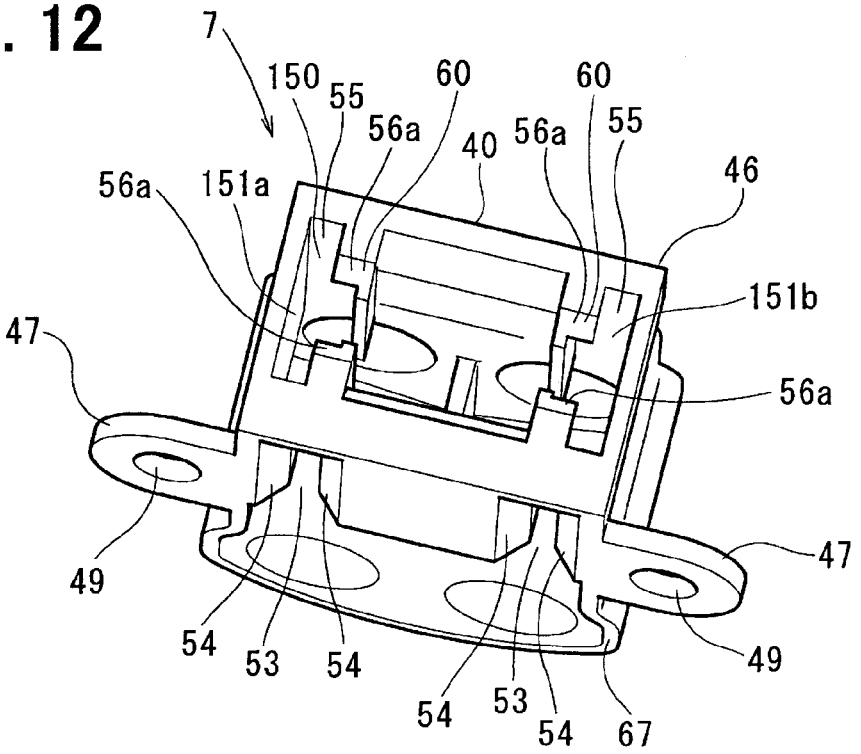
FIG. 12 is a perspective view showing a yoke contact surface of a holder according to a second embodiment of the present disclosure.
Figure 13:
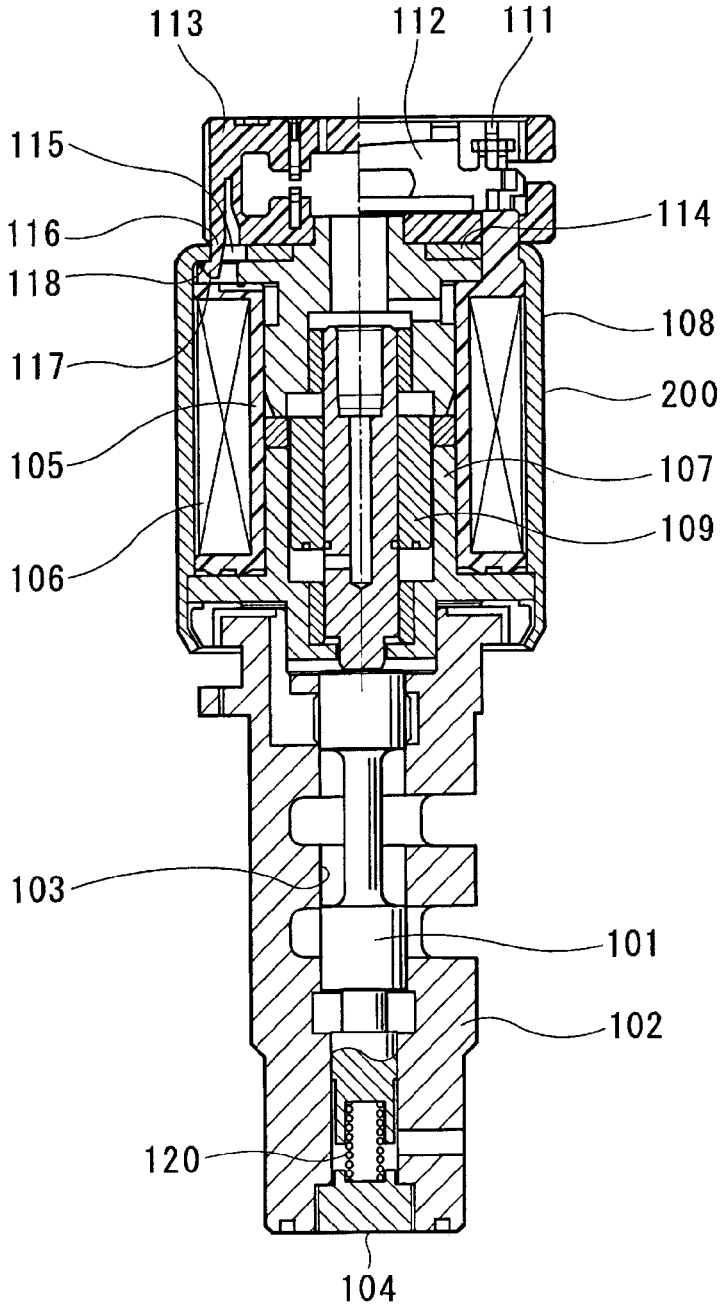
FIG. 13 PRIOR ART
FIG. 13 is a cross-sectional view of a prior art solenoid spool valve.

FIG. 12 shows a linear solenoid valve that has a linear solenoid according to a second embodiment of the present disclosure.

In the following discussion, the components, which are similar to those of the first embodiment, will be indicated by the same reference numerals and will not be described further for the sake of simplicity.

The linear solenoid valve (the solenoid spool control valve, the solenoid valve) of the present embodiment includes the spool control valve and the linear solenoid 100. The linear solenoid 100 includes the coil 1, the bobbin 3, the coil lead lines 4, the yoke 5, the connector (the two terminals 6, the holder 7 and the two clips 8) 40, the plunger 29, and the stator core 130 (including the stator core portion 31, the stator core portion 32, and the magnetic resistance portion 33).

The holder 7 includes the connector case 46, the two flanges 47 and the reinforcing ribs 48.

The chamber sections 151*a*, 151*b*, each of which includes the primary terminal receiving chamber 51 and the secondary terminal receiving chamber 52, are formed in the inside of the connector case 46 of the holder 7.

The two primary terminal insertion holes 53 are opened at the yoke 5 side end surface (the yoke contact surface 67) of the connector case 46, which is located on the yoke 5 side. At the time of installing the holder 7 to the outer surface 11*a* (the holder installation seat surface 12) of the bottom portion 11 of the yoke 5, the fork terminal portion 23 of each terminal 6 is inserted into the corresponding primary terminal receiving chamber 51 through the corresponding primary terminal insertion hole 53. Each primary terminal insertion hole 53 includes the two tapered guide surfaces (the pair of tapered guide surfaces) 54, which are opposed to each other and are tapered toward the inside of the corresponding primary terminal receiving chamber 51 (i.e., the inside of the corresponding chamber section 151*a*, 151*b*) to guide the fork terminal portion 23 of the corresponding terminal 6 into the corresponding primary terminal receiving chamber 51. Specifically, in each primary terminal insertion hole 53, the tapered guide surfaces 54 are opposed to each other to form the V-shape, and the cross-sectional area of the opening defined between the guide surfaces 54 (i.e., the cross-sectional area of the opening of the primary terminal insertion hole 53) is progressively reduced from the outer opening end of the opening defined between the guide surfaces 54 toward the depth side of the opening defined between the guide surfaces 54, and the insertion path, which is configured into the rectangular shape, is formed in the bottom of the opening defined between the guide surfaces 54 to enable insertion of the fork terminal portion 23 through the insertion path.

The two secondary terminal insertion holes 55 are formed in the side surface (the front side surface) of the connector case 46. The tab terminal portion 25 of each external mating terminal 9 is inserted into the corresponding secondary terminal receiving chamber 52 through the corresponding secondary terminal insertion hole 55. A guide groove 60 is formed in each secondary terminal insertion hole 55 to guide the tab terminal portion 25 of the corresponding external mating terminal 9 to the predetermined location in the corresponding secondary terminal receiving chamber 52. The guide groove 60 has two tapered guide surfaces (a pair of tapered guide surfaces) 56*a*, which are opposed to each other and are tapered toward the inside of the corresponding secondary terminal receiving chamber 52 (i.e., the inside of the corresponding chamber section 151*a*, 151*b*) to guide the tab terminal portion 25 of the corresponding external mating terminal 9 to the predetermined location in the secondary terminal receiving chamber 52. Specifically, in the guide groove 60 of each secondary terminal insertion hole 55, the tapered guide surfaces 56*a* are opposed to each other to form a V-shape, and a cross-sectional area of an opening defined between the guide surfaces 56*a* (i.e., a cross-sectional area of an opening of the guide groove 60 of the secondary terminal insertion hole 55) is progressively reduced from an outer opening end of the opening defined between the guide surfaces 56*a* toward a depth side of the opening defined between the guide surfaces 56*a*, and an insertion path, which is configured into a rectangular shape, is formed in the bottom of the opening defined between the guide surfaces 56*a* to enable insertion of the tab terminal portion 25 through the insertion path.

As discussed above, the linear solenoid valve of the present embodiment provides the advantages, which are similar to those of the first embodiment.

Now, modifications of the above embodiments will be described.

In the above embodiments, the solenoid of the present disclosure is applied as the linear solenoid (the solenoid actuator) that drives the spool control valve installed in the oil pressure control apparatus, which executes the oil pressure control operation of the automatic transmission of the vehicle. Alternatively, the solenoid of the present disclosure may be applied to an electric motor, a power generator (an alternator), a solenoid switch, or a coil apparatus of, for example, an ignition coil or a transformer.

The conductor bodies, which are connected to the coil, may be brushes that are urged against a commutator, which is electrically connected to a rotor coil of the electric motor. Alternatively, the conductor bodies, which are connected to the coil, may be brushes that are urged against a slip ring, which is electrically connected to the rotor coil of the alternator.

Furthermore, each of the terminals may be a brush terminal that includes an inner connection, which is electrically connected to the corresponding brush, and an outer connection, which is fitted to and is electrically connected to a corresponding external mating terminal.

In the above embodiments, the solenoid of the present disclosure is applied to the linear solenoid that drives the spool control valve installed in the oil pressure control apparatus, which executes the oil pressure control operation of the automatic transmission of the vehicle. Alternatively, the solenoid of the present disclosure may be applied as a solenoid (a linear solenoid) that drives a spool control valve used in a fluid pressure control operation, a flow quantity control operation, or a flow passage changing operation.

Furthermore, the solenoid of the present disclosure may be applied as a linear solenoid that drives a spool valve, which is a valve element of an oil control valve (OCV) used in a variable valve timing (VVT) system that changes opening timing and closing timing of an intake valve or an exhaust valve of an internal combustion engine.

Furthermore, the present disclosure may be applied to a linear solenoid that drives another type of valve, such as a ball valve or a poppet valve, in place of the spool control valve.

Furthermore, the structure of the present disclosure may be applied to a movable core, which has a shaft and a plunger that are formed integrally. Furthermore, the shaft may be made of a magnetic material.

In the above embodiments, the solenoid spool control valve (the solenoid valve) of the normally open (N/O) type is used as the linear solenoid valve of the present disclosure. Alternatively, the linear solenoid valve of the present disclosure may be a solenoid spool control valve (a solenoid valve) of a normally closed (N/C) type, which discommunicates between an input port and an output port and communicates between the output port and a drain port at the time of stopping the supply of an electric power to the solenoid coil and increases a cross-sectional area of a communicating passage between the input port and the output port in a stepwise manner or a linear manner and decreases the cross-sectional area of the communicating passage between the output port and the drain port in a stepwise manner or a linear manner at the time of increasing the supply of the electric power to the solenoid coil.

In the above embodiments, the inserting direction of the external mating terminals is set to be the direction that is perpendicular to the solenoid axial direction. Alternatively, the inserting direction of the external mating terminals may be set to be a different direction, which is different from the solenoid axial direction, or a different direction, which is within a predetermined angular range (e.g., 85 to 105 degrees) relative to the solenoid axial direction.

Additional advantages and modifications will readily occur to those skilled in the art. The present disclosure in its broader terms is therefore not limited to the specific details, representative apparatus, and illustrative examples shown and described.

What is claimed is:

1. A solenoid comprising:

a yoke that is configured into a cup form and forms a magnetic circuit in cooperation with a coil;

an inside-to-outside communication hole that extends through a bottom portion of the yoke to communicate between an inside and an outside of the yoke;

a positioning projection that projects outward from a corresponding part of an outer surface of the bottom portion, which is different from the inside-to-outside communication hole;

a plurality of terminals that project from the inside of the yoke to the outside of the yoke through the inside-to-outside communication hole to connect with a plurality of external mating terminals of an external mating connector, which conduct an electric current to energize the coil;

a holder that is installed to the outer surface of the bottom portion and closes the inside-to-outside communication hole, wherein the holder includes a terminal receiving space, which is formed in an inside of the holder to receive and hold the plurality of terminals, and a fitting hole, into which the positioning projection is fitted, and the fitting hole is placed on an outer side of the terminal receiving space; and a clip that is made of a resilient material and fixes the holder to the outer surface of the bottom portion, wherein:

the clip includes:

an engaging hole that is press fitted to an outer peripheral surface of the positioning projection; and a radially-inner-side engaging portion that is configured into a form of a loop and resiliently contacts the outer peripheral surface of the positioning projection;

the holder includes:

a yoke contact surface that is configured into a form of a loop and surrounds the plurality of terminals, wherein the yoke contact surface contacts the outer surface of the bottom portion; and a clip installation seat that is configured into a form of a loop and extends radially outward from a peripheral edge part of the fitting hole;

the clip installation seat includes a recessed slope surface that is configured into a form of a loop and is sloped in such a manner that an amount of recess of a radially-inner-side section of the recessed slope surface is larger than an amount of recess of a radially-outer-side section of the recessed slope surface, which is located on a radially outer side of the radially-inner-side section of the recessed slope surface; and the clip includes a radially-outer-side engaging portion that is configured into a form of a loop and is placed at a radially-outer-side area of the clip, wherein the radially-outer-side engaging portion resiliently contacts the recessed slope surface.

2. The solenoid according to claim 1, wherein the radially-outer-side engaging portion is an urging portion that contacts the recessed slope surface to exert an urging force that urges the yoke contact surface of the holder against the bottom portion of the yoke when the radially-outer-side engaging portion contacts the clip installation seat.

3. The solenoid according to claim 1, wherein the holder includes:

a case that is configured into a tubular form and forms the terminal receiving space in an inside of the case; and a rib that projects outward from an outer surface of the case and limits warping of the yoke contact surface relative to the outer surface of the bottom portion.

4. The solenoid according to claim 1, wherein:

the plurality of terminals includes two terminals;

the plurality of external mating terminals includes two external mating terminals;

each of the two terminals includes a primary outer terminal portion that connects between a corresponding one of two internal conductor portions and a corresponding one of the two external mating terminals, wherein each of the two internal conductor portions forms a corresponding part of the coil or is connected to the coil;

each of the two external mating terminals includes a tab terminal portion that is engageable with the primary outer terminal portion of a corresponding one of the two terminals; and the terminal receiving space of the holder includes two chamber sections, each of which receives and holds the primary outer terminal portion of a corresponding one of the two terminals and the tab terminal portion of a corresponding one of the two external mating terminals.

5. The solenoid according to claim 4, wherein the holder includes:

two primary openings, through which the primary outer terminal portions of the two terminals are respectively inserted into the two chamber sections at a time of installing the holder to the yoke; and two secondary openings, through which the tab terminal portions of the two external mating terminals are respectively inserted into the two chamber sections at a time of fitting the external mating connector to the holder or at a time of fitting the two external mating terminals to the two terminals.

6. The solenoid according to claim 5, wherein:

at least one of each primary opening and each secondary opening includes at least one pair of tapered guide surfaces, which are opposed to each other and are tapered toward an inside of a corresponding one of the two chamber sections, to guide a corresponding one of the primary outer terminal portions of the two terminals and the tab terminal portions of the two external mating terminals to a predetermined location in the corresponding one of the two chamber sections; and the at least one of each primary opening and each secondary opening has a cross-sectional area that is progressively reduced by the at least one pair of tapered guide surfaces toward a deep side of the corresponding one of the two chamber sections.

7. The solenoid according to claim 5, further comprising a molded member that projects outward from the outer surface of the bottom portion of the yoke and holds:

a part of each of the two internal conductor portions, each of which forms the corresponding part of the coil or is connected to the coil; and base end portions of the two terminals;

the molded member includes a projection, which projects outward from the yoke through the inside-to-outside communication hole and is inserted into the two chamber sections through the two primary openings;

the holder includes:

a partition wall that partitions between the two chamber sections; and a fitting protrusion that is formed in an end portion of the partition wall, which is located on a side where the yoke is placed; and the projection includes a fitting recess, which is placed at a location that corresponds to the fitting protrusion to form a labyrinth between an inner surface of the fitting recess and the fitting protrusion.

8. The solenoid according to claim 4, wherein:

each of the two terminals includes an electrode portion;

the electrode portions of the two terminals are received in the two chamber sections, respectively;

two external test contacts, which are used to test a state of electrical conductivity of the coil and the two terminals, are respectively contactable with the electrode portions of the two terminals; and the two secondary openings serve as two contact insertion holes, respectively, through which the two external test contacts are insertable toward the two electrode portions from an outside of the holder.

9. The solenoid according to claim 1, wherein the holder includes at least one reinforcing portion, and the at least one reinforcing portion contacts the plurality of terminals and receives a load applied to the plurality of terminals at a time of fitting the external mating connector to the holder or at a time of fitting the plurality of external mating terminals to the plurality of terminals.

10. The solenoid according to claim 1, wherein:

the yoke includes a holder installation seat surface, to which the holder is installed in a state where the yoke contact surface of the holder tightly contacts the holder installation seat surface; and the holder installation seat surface surrounds the inside-to-outside communication hole on the outer surface of the bottom portion of the yoke.

11. The solenoid according to claim 10, wherein the positioning projection linearly extends from the outer surface of the bottom portion or the holder installation seat surface to the outside of the yoke.

12. The solenoid according to claim 1, wherein:

the fitting hole has an inner diameter that is slightly larger than an outer diameter of the positioning projection; and the fitting hole extends through a center portion of the clip installation seat in a thickness direction of the clip installation seat, which is parallel to an axis of the positioning projection.

13. The solenoid according to claim 1, wherein:

the engaging hole has an inner diameter that is smaller than an outer diameter of the positioning projection in a state that is before installation of the clip to the positioning projection; and the engaging hole extends through a center portion of the clip in a thickness direction of the clip, which is parallel to an axis of the positioning projection.

14. The solenoid according to claim 1, wherein:

the clip includes a radially-inner-side clip portion, which is configured into a circular truncated cone form that radially outwardly flared from a peripheral edge part of the engaging hole of the clip; and the radially-inner-side engaging portion is formed in an inner peripheral edge part of the radially-inner-side clip portion.

15. The solenoid according to claim 14, wherein:

the clip includes a radially-outer-side clip portion, which is configured into an inverted circular truncated cone form and is placed on a radially outer side of the radially-inner-side clip portion; and the radially-outer-side engaging portion is formed in an outer peripheral edge part of the radially-outer-side clip portion.

* * * * *